US009909326B2

(12) United States Patent
Preston

(10) Patent No.: US 9,909,326 B2
(45) Date of Patent: Mar. 6, 2018

(54) SCAFFOLDING

(76) Inventor: John Clement Preston, Silverwater (AU)

( * ) Notice: Subject to any disclaimer, the term of this patent is extended or adjusted under 35 U.S.C. 154(b) by 0 days.

(21) Appl. No.: 13/581,036

(22) PCT Filed: Feb. 25, 2011

(86) PCT No.: PCT/AU2011/000213

§ 371 (c)(1),
(2), (4) Date: Oct. 15, 2012

(87) PCT Pub. No.: WO2011/103639

PCT Pub. Date: Sep. 1, 2011

(65) Prior Publication Data

US 2013/0048430 A1 Feb. 28, 2013

(30) Foreign Application Priority Data

Feb. 25, 2010 (AU) ..... 2010900812
Sep. 14, 2010 (AU) ..... 2010904143

(51) Int. Cl.

| | |
|---|---|
| ***E04G 1/17*** | (2006.01) |
| ***E04G 1/08*** | (2006.01) |
| ***E04G 1/34*** | (2006.01) |
| *E04G 5/14* | (2006.01) |

(52) U.S. Cl.
CPC ..... *E04G 1/17* (2013.01); *E04G 1/08* (2013.01); *E04G 1/34* (2013.01); *E04G 2005/148* (2013.01)

(58) Field of Classification Search
CPC .... E04G 1/06; E04G 1/14; E04G 1/17; E04G 5/04; E04G 1/08; E04G 1/34; E04B 1/34807; E04B 1/6158; E06C 1/10
USPC ..... 182/178.1, 178.2, 178.3, 178.4, 178.5; 52/79.12
See application file for complete search history.

(56) References Cited

U.S. PATENT DOCUMENTS

| | | | | | |
|---|---|---|---|---|---|
| 3,500,595 | A | * | 3/1970 | Bennett | 52/79.13 |
| 3,550,334 | A | * | 12/1970 | Van Der Lely | 52/79.7 |
| 3,564,802 | A | * | 2/1971 | Dreyfus | 52/637 |
| 3,613,321 | A | * | 10/1971 | Rohrer | 52/73 |
| 3,638,380 | A | * | 2/1972 | Perri | 52/79.12 |
| 3,703,058 | A | * | 11/1972 | Klett et al. | 52/79.13 |
| 3,722,168 | A | * | 3/1973 | Comm | 52/745.03 |
| 3,750,366 | A | * | 8/1973 | Rich et al. | 52/79.11 |

(Continued)

FOREIGN PATENT DOCUMENTS

| | | |
|---|---|---|
| DE | 2447820 A1 | 4/1976 |
| EP | 754819 A1 | 1/1997 |

(Continued)

OTHER PUBLICATIONS

International Search Report for Application No. PCT/AU2011/000213, dated Jun. 6, 2011.

(Continued)

*Primary Examiner* — Colleen M Chavchavadze

(57) ABSTRACT

A scaffolding module comprising: a frame that, when in an erected configuration, defines an interior space; and a plurality of mounting regions that allow the module to be mounted with other said scaffolding modules, wherein when so mounted, the module frames are able to be interconnected to form a support structure for one or more scaffolding platforms.

14 Claims, 29 Drawing Sheets

(56) References Cited

U.S. PATENT DOCUMENTS

| | | | | | |
|---|---|---|---|---|---|
| 3,807,120 | A | * | 4/1974 | Viandon | 52/638 |
| 3,822,519 | A | * | 7/1974 | Antoniou | 52/79.13 |
| 3,849,952 | A | * | 11/1974 | Hanaoka | 52/79.5 |
| 3,866,672 | A | * | 2/1975 | Rich et al. | 165/50 |
| 3,881,571 | A | | 5/1975 | Moulton | |
| 3,903,664 | A | * | 9/1975 | Doriel | 52/79.12 |
| 4,059,931 | A | * | 11/1977 | Mongan | 52/79.12 |
| 4,073,100 | A | * | 2/1978 | DiGiovanni, Jr. | 52/79.3 |
| 4,364,206 | A | * | 12/1982 | Wybauw | 52/79.7 |
| 4,620,404 | A | * | 11/1986 | Rizk | 52/602 |
| 4,723,381 | A | * | 2/1988 | Straumsnes | 52/79.12 |
| 4,858,726 | A | * | 8/1989 | Preston | 182/152 |
| 5,127,492 | A | | 7/1992 | Preston | |
| 5,491,939 | A | | 2/1996 | Wang | |
| 5,625,998 | A | * | 5/1997 | Madsen | 52/745.03 |
| 5,755,063 | A | * | 5/1998 | Ohnishi et al. | 52/79.8 |
| 5,765,248 | A | | 6/1998 | Ono | |
| 5,810,114 | A | * | 9/1998 | White | 182/178.5 |
| 6,601,716 | B1 | | 8/2003 | Hayman et al. | |
| 7,069,701 | B2 | * | 7/2006 | Chen | 52/580 |
| 8,356,446 | B2 | * | 1/2013 | Takeda et al. | 52/79.12 |
| 8,439,166 | B2 | * | 5/2013 | Kreller | 182/178.1 |
| 8,499,527 | B2 | * | 8/2013 | Kobayashi et al. | 52/745.2 |
| 2005/0263351 | A1 | | 12/2005 | Hayes | |

FOREIGN PATENT DOCUMENTS

| | | | |
|---|---|---|---|
| GB | 2129905 | A | 5/1984 |
| JP | 55-47520 | | 3/1980 |
| JP | 57-56938 | | 4/1982 |
| JP | 4-277261 | A | 10/1992 |
| JP | 4-350255 | B2 | 12/1992 |
| JP | 05-033498 | B2 | 2/1993 |
| JP | 2003-138742 | | 5/2003 |
| JP | 2004-218282 | | 8/2004 |
| JP | 2004-346552 | A | 12/2004 |
| JP | 2004-346652 | A | 12/2004 |
| JP | 3121964 | | 5/2006 |
| KR | 10-2002-0025073 | | 4/2002 |
| TW | 228864 | | 8/1994 |
| TW | 307656 | | 3/2007 |
| TW | 369362 | | 11/2009 |
| WO | WO-90/14479 | A1 | 11/1990 |

OTHER PUBLICATIONS

International Preliminary Report on Patentability for Application No. PCT/AU2011/000213, dated Jun. 26, 2012.

Office Action in JP Application No. 2012-554173 dated Feb. 18, 2014.

Extended European Search Report in Application No. 11746766.2 dated Jul. 7, 2014.

Office Action in Taiwan Application No. 100106559 dated Dec. 4, 2014.

Office Action in KR Application No. 10-2012-7025093 dated Nov. 20, 2015, 27 pages.

Office Action in JP Application No. 2015-101528 dated Mar. 7, 2017, 5 pages.

Examination Report in AU Application No. 2011220341 dated Oct. 7, 2014.

Examination Report in GCC Application No. GC 2011-17863 dated Aug. 25, 2014.

* cited by examiner

FIG 7a
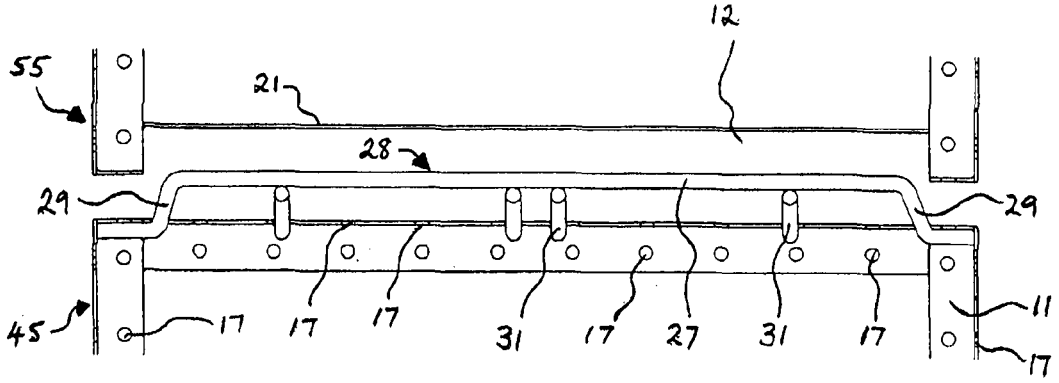
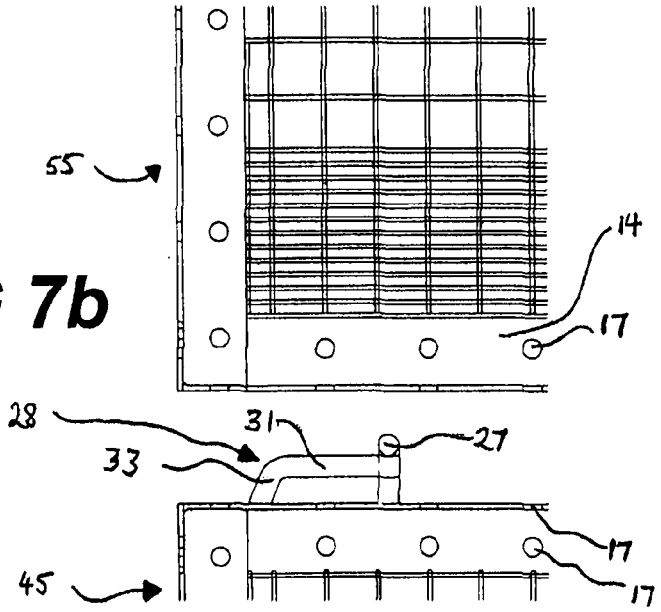
FIG 7b
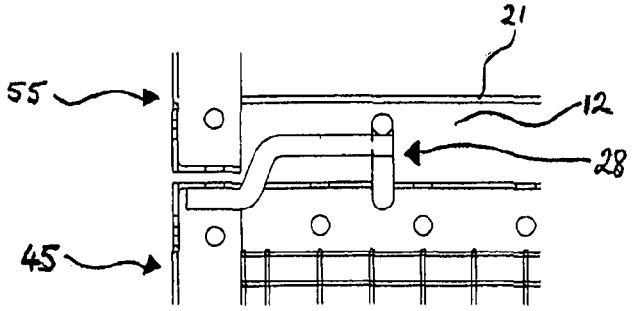
FIG 7c

FIG 17
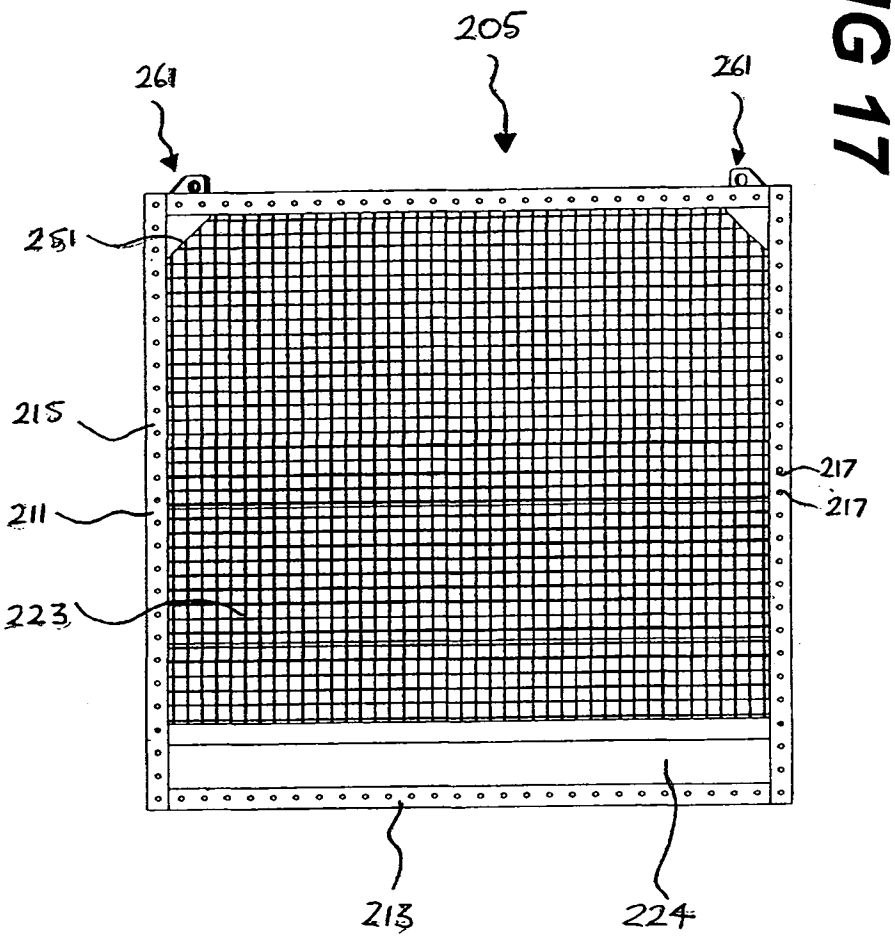
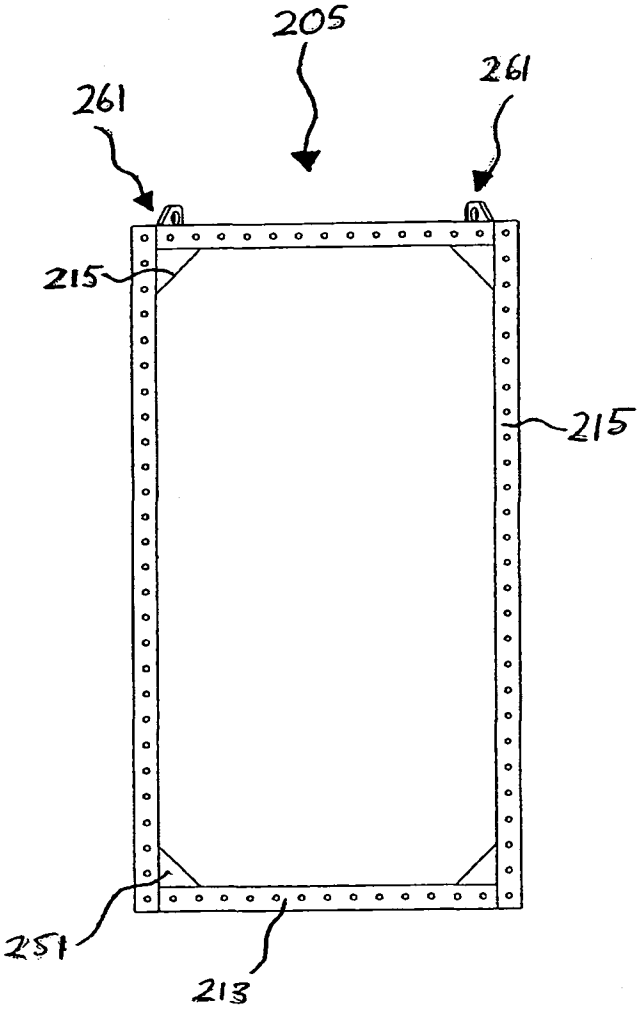
FIG 18

FIG 21
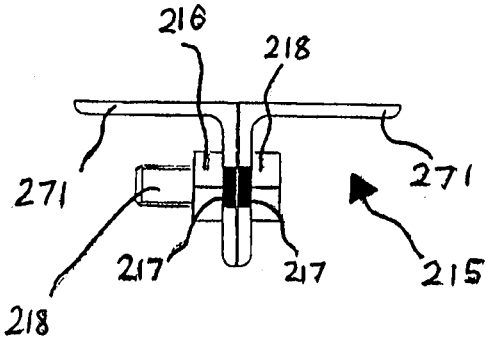
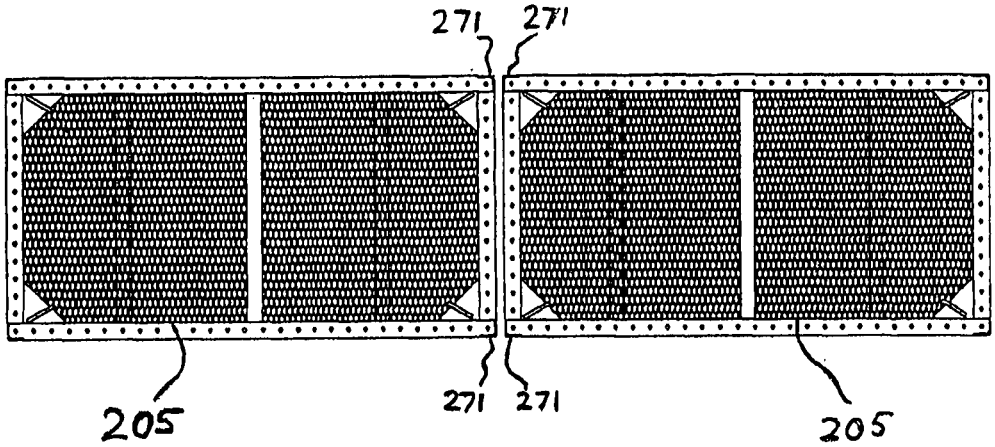
FIG 22

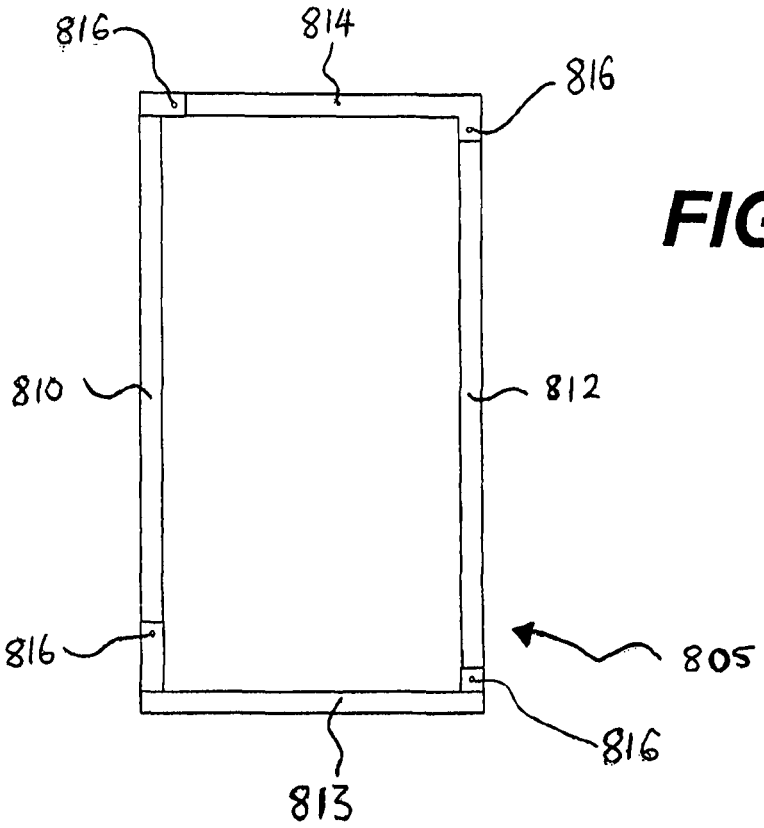
FIG 32
FIG 33
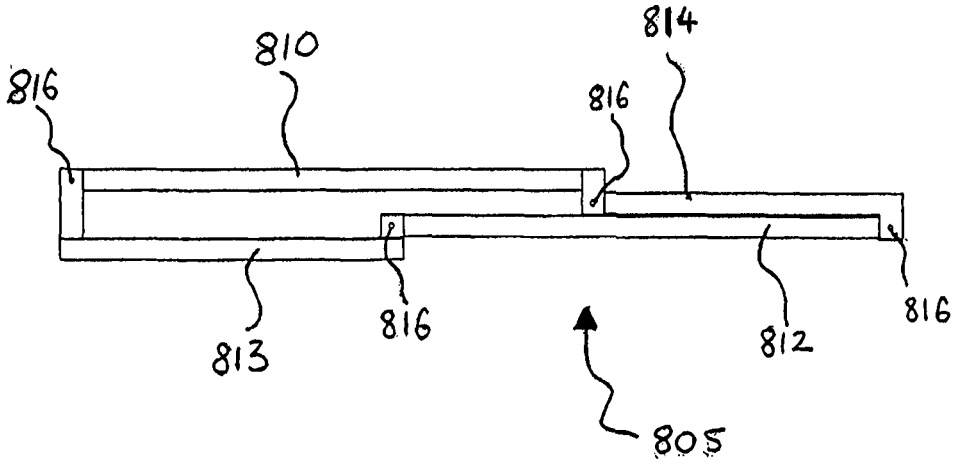

SCAFFOLDING

TECHNICAL FIELD

The present invention relates generally to scaffolding. The invention has been developed especially but not exclusively, for use in multistorey scaffolding for use in the construction, renovation or maintenance of buildings and other structures, and is herein described in that context. However, it is to be appreciated that aspects of the invention may have broader application, and is not limited to that use.

BACKGROUND OF THE INVENTION

The use of scaffolding for construction, renovation or maintenance of buildings is well known. Scaffolding provides a working platform for workers to safely access areas of the building that would otherwise be too high or inaccessible from the floor. Scaffolding may also incorporate safety barriers, which reduces the chance of the workers, tools, loose material and debris from falling from the confines of the scaffolding. Thus the use of scaffolding is important in ensuring a safe work site.

Conventional scaffolding can take varying forms, although it generally consists of vertical and horizontal members supporting a platform. In the past, scaffold structures were constructed from wood, and in some countries, bamboo scaffolding comprising of lengths of bamboo tied together is still used.

Modern day scaffolding generally comprises of a system of tubular metal pipes coupled together, and tied to the building to form the overall scaffolding framework. Scaffold planks, supported by the transoms of scaffolding framework provide the working platform. Such systems are known as "modular scaffolding", with individual tubular metal pipes, coupling and ties as the basic modular units.

Such prior art scaffolding require experienced scaffolders to carefully assemble the tubes, couplers and boards together to form the scaffolding. Consequently, for a large structure this requires significant skilled labour, time and cost to safely erect the scaffolding.

Furthermore, even a scaffolding of modest size would contains hundreds of components to be fit together and checked. Thus the integrity of the scaffolding structure is dependent on the scaffolder diligently installing and checking each component. With the pressure of time, fatigue or inclement weather, the scaffolder may be overburdened, leading to possible errors. Also the large number of components of the prior art system requires significant time to erect, and during this erection stage of the scaffolding, the workers around the unfinished scaffold would be working under perilous, and potentially hazardous conditions.

In prior art systems, the design of metal tubular pipes, also pose rigidity problems when coupling the scaffold together. As couplers generally rely on passing a section of the tubular pipe through an aperture or clamp in the coupler, there is little resistance to rotation around the axis of the pipe. That is, the coupling and tubular pipes may act as a pivot, rather than a rigid joint. Therefore, in prior art systems, it is essential to incorporate braces to increase rigidity of a large scaffold system.

SUMMARY OF THE INVENTION

In a first aspect of the invention, there is provided a scaffolding module comprising a frame that, when in an erected configuration, defines an interior space; and a plurality of mounting regions that allow the module to be mounted with other scaffolding modules, wherein when so mounted, the module frames are able to be interconnected to form a support structure for one or more scaffolding platforms. By providing modules with a frame, the overall scaffold is simplified by having fewer individual components.

In one form, the module further comprises at least one scaffolding platform section disposed in and supported by the frame, wherein the module includes mounting regions on opposite side faces of the frame so that the module may be mounted with other modules in a side by side relation. When so mounted, the respective scaffolding platform sections of the modules form at least part of one or more said scaffolding platforms that extends across the side by side mounted modules.

In one form, the platform section in the modules is mounted on a lower portion of the frame.

In one form, the scaffolding module includes mounting regions on the upper and lower faces of the frame so that the module may be mounted with other said modules one on top of the other. This enables the modules to be stacked one on top of each other, and the weight of a modules is distributed across the mounting regions of the rigid frame of the module below. Advantageously, the load is distributed, unlike conventional scaffold systems where loads are often concentrated at particular points where couples or joint pins join two tubular pipes.

In one form, the mounting regions are configured as surfaces which are arranged to abut in face to face relation with a corresponding mounting surface of another said module. Advantageously, the corresponding surfaces of two modules are in parallel planes, thereby spreading the load across the mounting surface without vectoring the load in another direction.

In another aspect, the present invention provides a scaffolding module comprising; a frame that, when in an erected configuration, defines an interior space; and a plurality of mounting regions that allow the module to be mounted with other scaffolding modules, wherein at least some of the mounting regions are configured as surfaces which are arranged to abut in face to face relation with a corresponding mounting surface of another said module. In one form, when the module is mounted with other said scaffolding modules, the modules form a support structure for one or more scaffolding platforms.

In one form, at least some of the mounting regions include pre-formed holes to receive mechanical fasteners to secure respective ones of the mounted modules together. The mechanical fasteners may be in the form of nut and bolts that pass through the holes and secure two respective mounting regions to each other. Other fasteners such as clamps or clips may be used.

In one form, the frame is rigid when in its erected configuration. A rigid frame provides strength to the scaffold system, thereby reducing the need or reliance on braces to increase rigidity as in prior art systems.

In one form, the frame is formed from a plurality of frame members. In a further form, the frame members are interconnected by rigid connections. The rigid connection may be welds between the frame members. Other types of rigid connections such as brackets or the like may be used.

In one form, at least some of the frame members are interconnected by releasable connections to allow the module to adopt a collapsed configuration.

In another form, at least some of the frame members are formed from profiled sections having an outer surface that forms a respective mounting region of the module.

In one form, at least one of the frame members is formed from an angle section. Angle sections are readily available, thus lowering the costs of manufacturing the modules. Furthermore, steel angle sections with flat and straight surfaces may be easily welded together.

In another form, the angle section is arranged to abut with a corresponding angle section of another module to form a T-section.

In one form, when the module is interconnected with another module, at least one of the sections of respective ones of the mounting regions are interconnected so as to be in intimate contact so as to act effectively as a unitary structure.

In one form, the frame has a plurality of external faces formed from respective ones of the frame members.

In one form, the module is arranged to be interconnected to another module with one face of the frame being in opposing relation with a face of the frame of the other module.

In one form, the respective opposing faces contain the mounting region which are in abutting relation with one another when the modules are interconnected.

In one form, the frame of the module is shaped as a prism. In a further form, the frame is cuboid. At least part of the frame defines the edges of the module shape, and the planar faces of the shape provide the faces of the module. It is to be appreciated the face of the frame is the planar face of that shape, and is not restricted to the actual surface of the members comprising the frame.

In one form, the module further comprises a guide arrangement to align at least one mounting region of the module with a mounting region of another module in mounting of the modules. Advantageously, a guide arrangement aids in aligning two modules together, allowing higher efficiency in the erection process. This may be of particular advantage where the modules are large or bulky, where it would be difficult for an worker to reposition and align modules with human effort.

In a further form, the guide arrangement is operative to align the mounting regions when mounting one module on top of another module. Advantageously, this allows a module, during positioning into the scaffold system to self align itself with another module disposed below. This reduces the effort required by the scaffolders to precisely manipulate the modules, cranes or other equipment during the erection process, thereby saving time and improving efficiency.

In one form, the guide arrangement comprises a guide structure that extends from one of an upper or lower face of the frame, and a recess in an opposite one of the upper or lower face of the frame. The guide structure and/or the recess may have ramped surfaces so that as a module is mounted on top of another module, the module is guided towards alignment.

In one form, the guide structure also provides a lifting point for the module. The lifting point provides a location to attach the module to a lifting device, such as a crane.

In another form, the guide arrangement comprises of at least one guide lug that extends from an upper face of the frame, and a recess in a lower face of the frame.

In one form the guide lug and/or recess comprises at least one ramped surface for aligning one module on top of another module.

In one form, an eyelet is provided in the guide lug for providing a lifting point for the module.

In one form, the module further comprises a barrier structure extending across an outer face of the module. The barrier structure may comprise of a safety mesh, kickboard and/or handrails for the protection of workers.

In another aspect, the present invention provides a panel comprising: a panel frame; and at least one mounting region that allows the panel to be mounted to at least one of the mounting regions of the scaffolding module, wherein when so mounted to a scaffolding module, the panel covers at least part of one face of the scaffolding module.

In another aspect, the present invention provides a scaffolding assembly comprising: a support structure comprising the frames of a plurality of scaffolding modules according to any form described above that are connected together; and one or more work platforms supported on the support structure.

In one form, the scaffolding assembly further comprises at least one base module supporting the support structure formed from scaffolding modules, wherein the base module (s) is adjustable in height and/or orientation. An adjustable base is advantageous in areas where the underlying ground surface is not perfectly flat. Adjusting the height and/or orientation of the base module, advantageously provides a method of compensating for uneven ground surfaces. Thereby erecting the overlying support structure may maintain a desired vertical orientation.

In one form, the at least one base module further comprises of a plurality of height adjustable legs. The adjustable legs may be in the form of screw jacks, allowing the scaffolder to infinitely adjust the height and/or orientation of the base module. The legs may have feet to distribute the weight of the support structure to the ground.

In one form, the scaffolding assembly further comprising ties for securing the scaffolding assembly to an adjacent structure. Ties advantageously provide stability for the scaffolding assembly relative to another structure, such as a building. Conversely, a scaffolding assembly tied to a less stable structure, may provide support to the less stable structure.

In one form, the scaffolding assembly further comprises at least one panel, wherein the panel is mounted on at least part of one face of at least one of the plurality of scaffolding modules.

In another aspect, the present invention provides a method of erecting scaffolding comprising: providing a plurality of modules; arranging the plurality of scaffolding modules in a predetermined manner; and securing scaffolding modules together.

In one form, the method further comprises arranging the plurality of scaffolding modules in a predetermined manner by hoisting and locating the modules with a crane.

In one form of the method, before arranging the plurality of scaffolding modules in a predetermined manner, at least two scaffolding modules are mounted to each other. It may be advantageous to mount two or more modules together before hoisting the mounted modules to their respective predetermined position in the support structure. Firstly this would reduce the number of hoisting operation by the crane. Furthermore, this advantageously reduces the number of final mounting operations required by the scaffolder once the modules are in place. Thus the erection of the support structure may be achieved in less time, and increasing the level of safety at the work site.

In one form, the method further comprises: providing at least one base module; adjusting the height and/or orientation of the base module; arranging the plurality of scaffolding modules on the at least one base module.

In one form of the method of erecting scaffolding, wherein each module has an in-use outer face, inner face, and two side faces, each face including a mounting region, the method includes locating the side face of at least one module in an abutting relationship with an inner face of another module, and securing the abutting mounting regions together.

In one form of the method of erecting scaffolding, wherein the predetermined arrangement includes one module spaced from another module, and the method further comprises; providing at least one panel; and mounting the at least one panel to at least one mounting region on each of the spaced modules, wherein the panel assembly interconnects the spaced modules.

In one form of the method, the method further comprises transporting the rigid framed scaffolding modules to a first site. In a further form of the method, after use of the scaffolding at the first site has ceased, the scaffolding modules may be relocated and erected at a second site. The method comprises demounting at least one scaffolding module from another scaffolding module in the support structure at the first site; transporting some of the rigid framed scaffolding modules from the first site to the second site; arranging the plurality of scaffolding modules in a predetermined manner at the second site; and mounting at least one scaffolding module to another scaffolding module to form a support structure at the second site.

The modules may be demounted to individual modules for transportation. Alternatively, two or more modules may maintain a mounted relationship during transportation, providing the overall size of the mounted modules can fit within the transport.

BRIEF DESCRIPTION OF THE DRAWINGS

FIG. 7*a* is a cross section side view of the upper portion and lower portion of two scaffolding module of FIG. 4;

FIG. 7*b* is a side view of part of the upper and lower portion of two scaffolding modules according to FIG. 4;

FIG. 7*c* is a cross section side view of part of the upper and lower portion of two scaffolding modules in alignment;

FIG. 17 is a front view of the module of FIG. 14;

FIG. 18 is a side view of the module of FIG. 14;

FIG. 21 is a sectioned view of a pair of frame members, illustrating the individual angle profile and combined T-section structure;

FIG. 22 is a top view of a pair of scaffolding modules in close proximity, prior to mounting to form a T-section structure from a pair of frame members;

FIG. 32 is a side view of another embodiment of a scaffolding module in a rigid configuration;

FIG. 33 is a side view of the module in FIG. 32 in the collapsed configuration;

DETAILED DESCRIPTION

Figure 1:
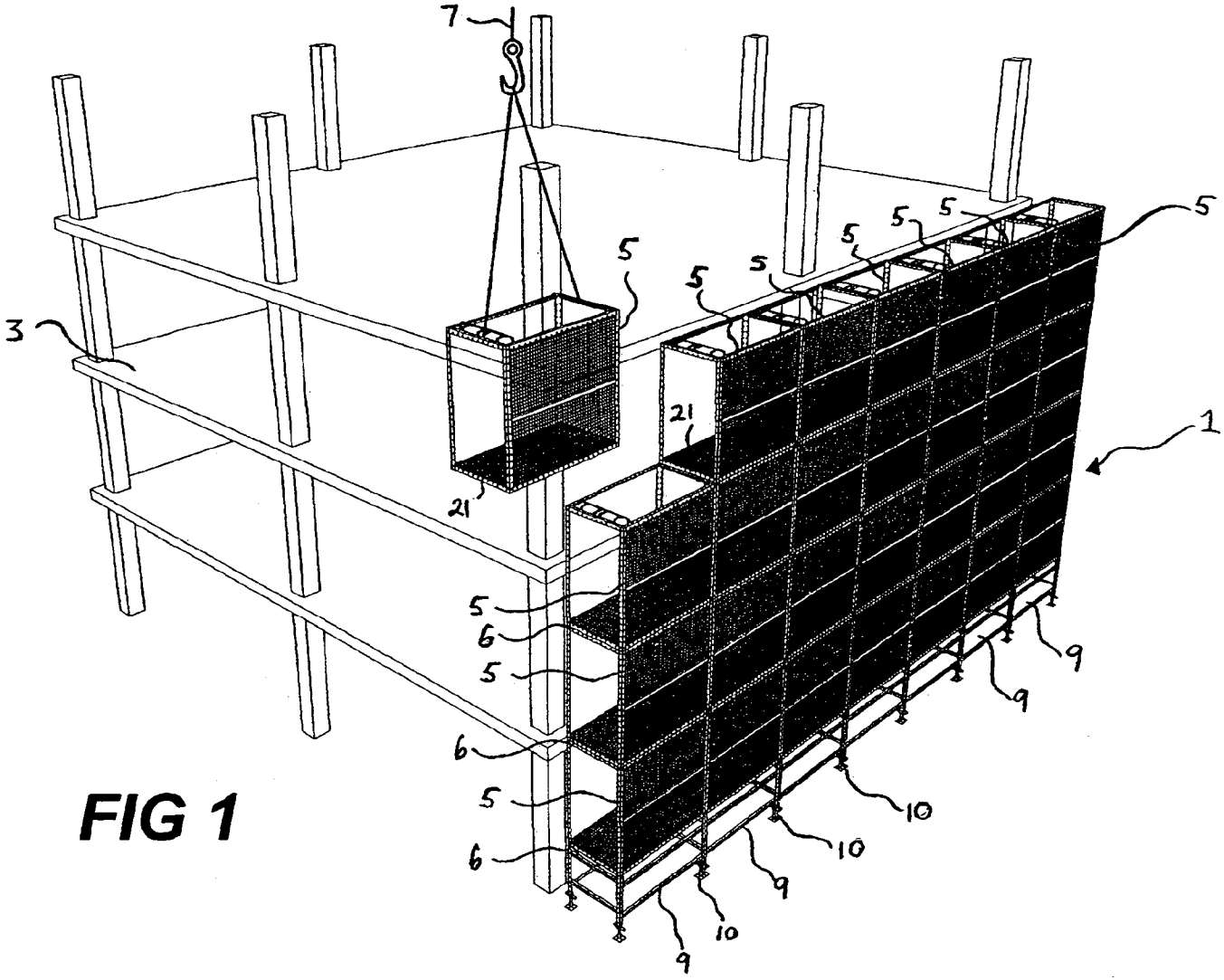
FIG. 1 is a perspective view of partially erected modular scaffolding on a building construction site.
Figure 2:
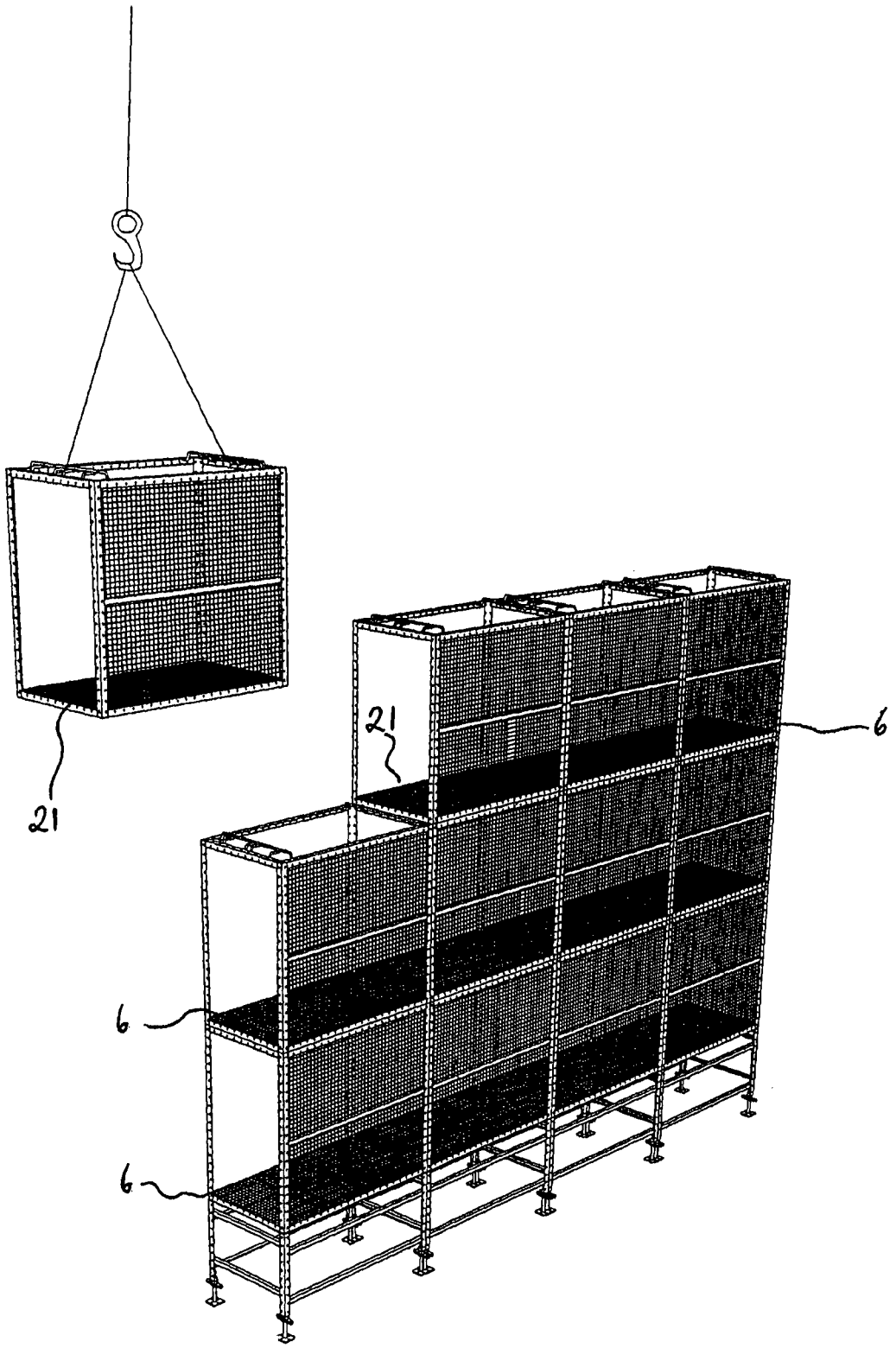
FIG. 2 is a perspective view of the modular scaffolding in FIG. 1, without the building for clarity.
Figure 3:
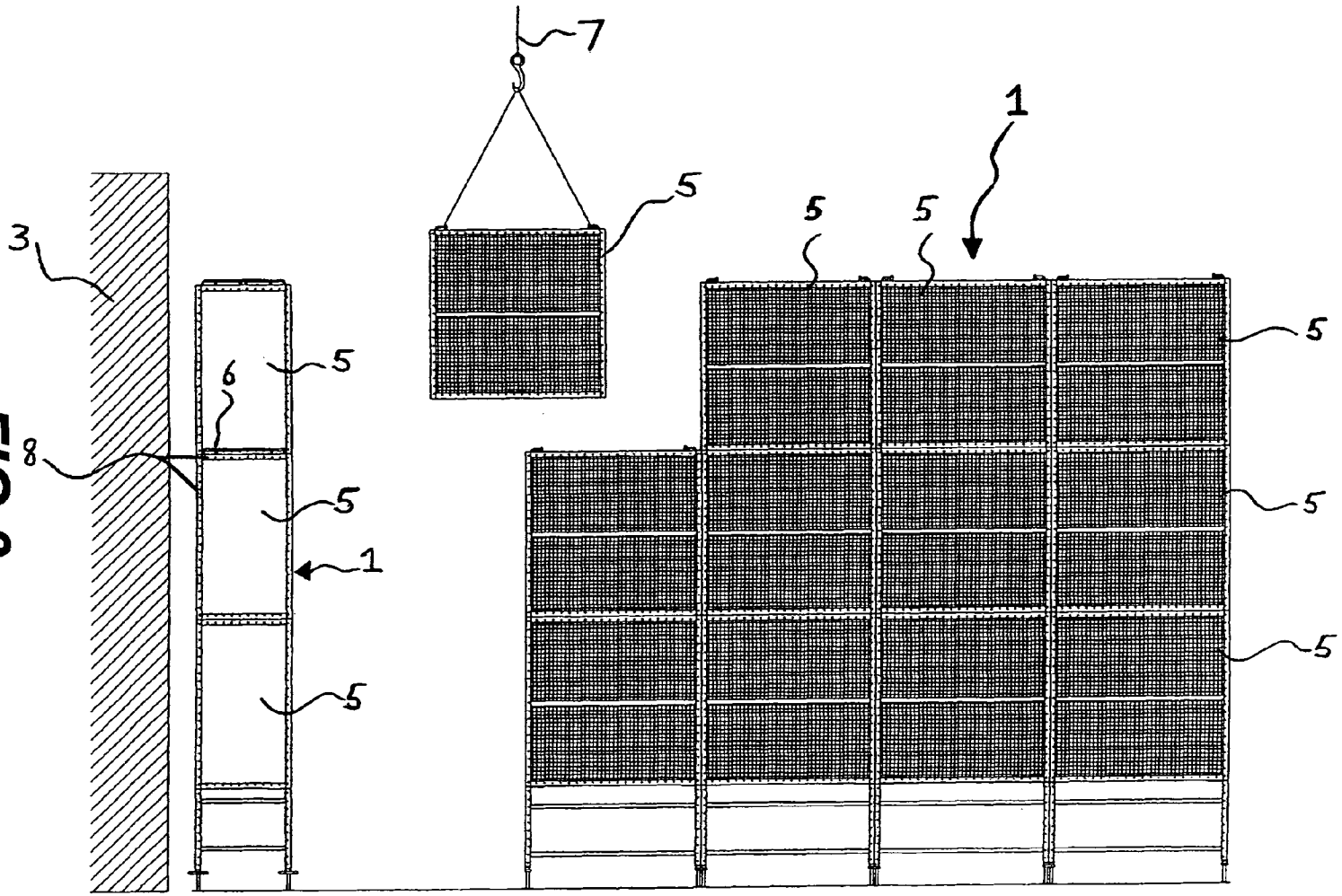
FIG. 3 is another view of partially erected modular scaffolding.

FIGS. 1 and 3 illustrate a partially erected scaffolding assembly 1 on a building 3 under construction. The scaffolding assembly 1 comprises of a plurality of modules 5, scaffolding base 9, and work platforms 6. The modules 5 are arranged vertically and horizontally in an array to form the main support structure for the scaffolding. The scaffold base 9 provides a base structure on which the modules 5 are mounted. The support structure formed by the modules 5 is secured to the building at intermittent intervals using building ties 8. The scaffolding platforms 6, which provides working platforms for workers are formed from multiple platform scaffolding sections 21 mounted within the individual modules 5 as will be described in more detail below.

As illustrated, the scaffolding assembly 1, may be erected by hoisting module 5 with a crane 7, and arranging the module(s) into the desired scaffold arrangement.

The modules 5 will now be described in detail with reference to FIGS. 4 to 6. The modules 5 are generally in the shape of rectangular or square prism blocks. The general rectangular prism shape is defined by a rigid frame 11, comprising of horizontal 13 and vertical 15 frame members, with the members having at least one flat surface co-planar to a face of the overall prism shape. To lower costs, these members are preferably made of 65 mm×65 mm×5 mm steel angles. In one embodiment, the overall dimension of the rigid frame 11 is approximately 2100 mm×2100 mm×1100 mm.

The flat surfaces of the horizontal 13 and vertical 15 frame members provide mounting regions for mounting with corresponding mounting regions of adjacent modules 5. The mounting regions are provided with a series of apertures 17. This allows adjacent modules to be coupled to each other with a combination of bolts and nuts, or other suitable mechanical fasteners. In a one form, the apertures are 18 mm in diameter, with the corresponding bolts having a shank diameter of 16 mm. This advantageously provides a degree of tolerance to the overall scaffolding assembly 1.

At the bottom face of the module 5 transoms 19 are provided to support part of the scaffolding platform section 21. The transoms 19 may be welded or integrally formed with the frame 11 or alternatively a separate component mounted to the frame. The scaffolding platform section 21 is in the form of a metal floor mesh, such as pierced steel secured to the frame 11. The floor mesh may comprise of 50 mm×50 mm×4 mm mesh, or expanded metal mesh for better grip and smaller holes. Advantageously, the floor mesh provides a light weight working platform for construction workers, as well as overhead protection from large debris. The floor mesh, also allows wind and water to pass through during inclement weather, thereby reducing the effects on the scaffolding. However, it is to be appreciated that other platforms, such as wooden floorboards or steel floorboards may be used as the scaffolding platform section 21.

Figure 4:
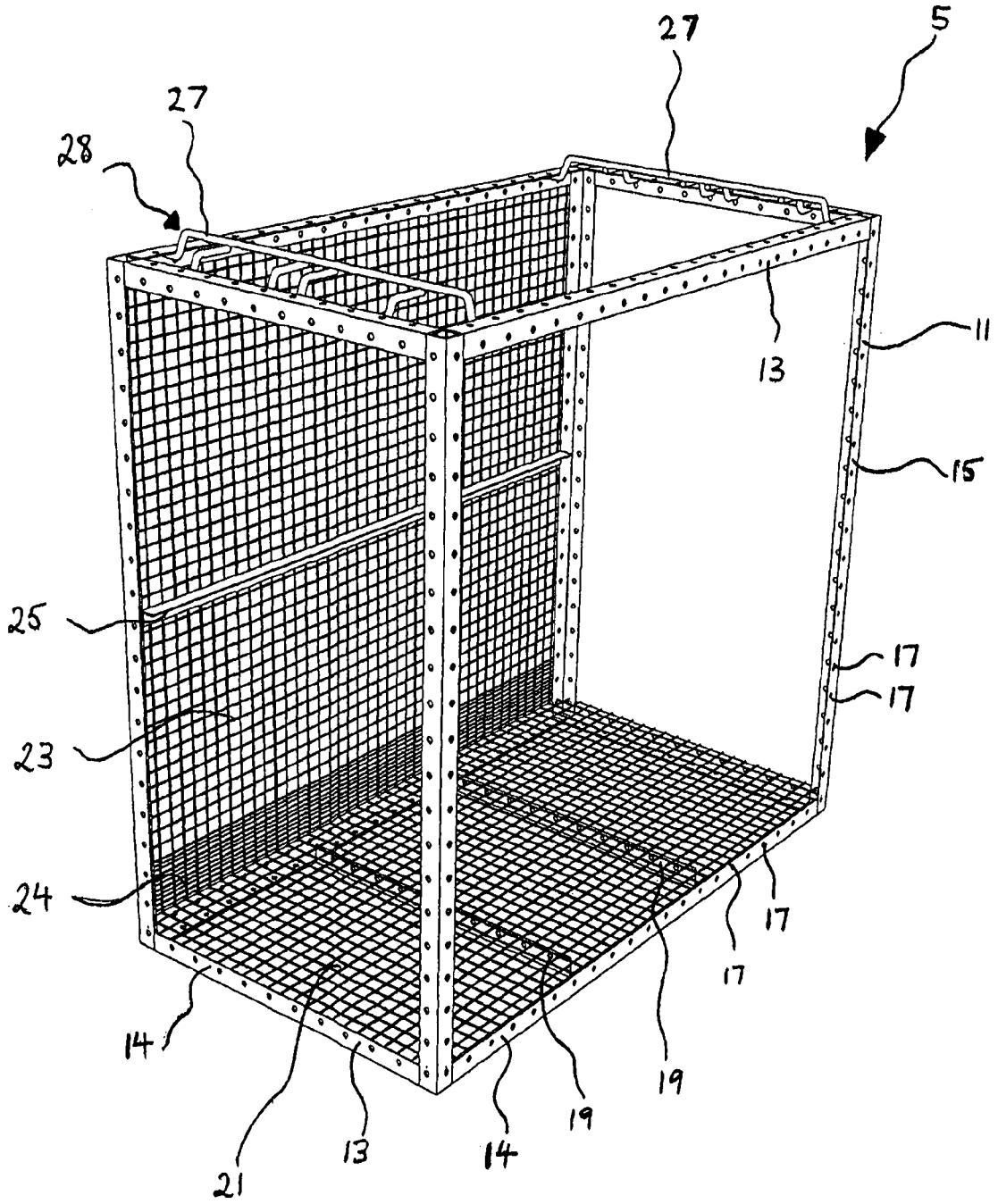
FIG. 4 is a perspective view of a scaffolding module.
Figure 5A:
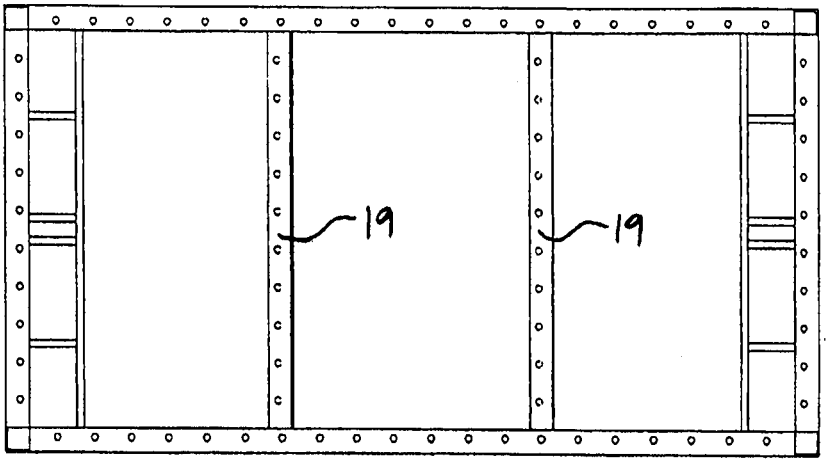
FIG. 5*a* is a top view of the scaffolding module of FIG. 4.
Figure 5B:
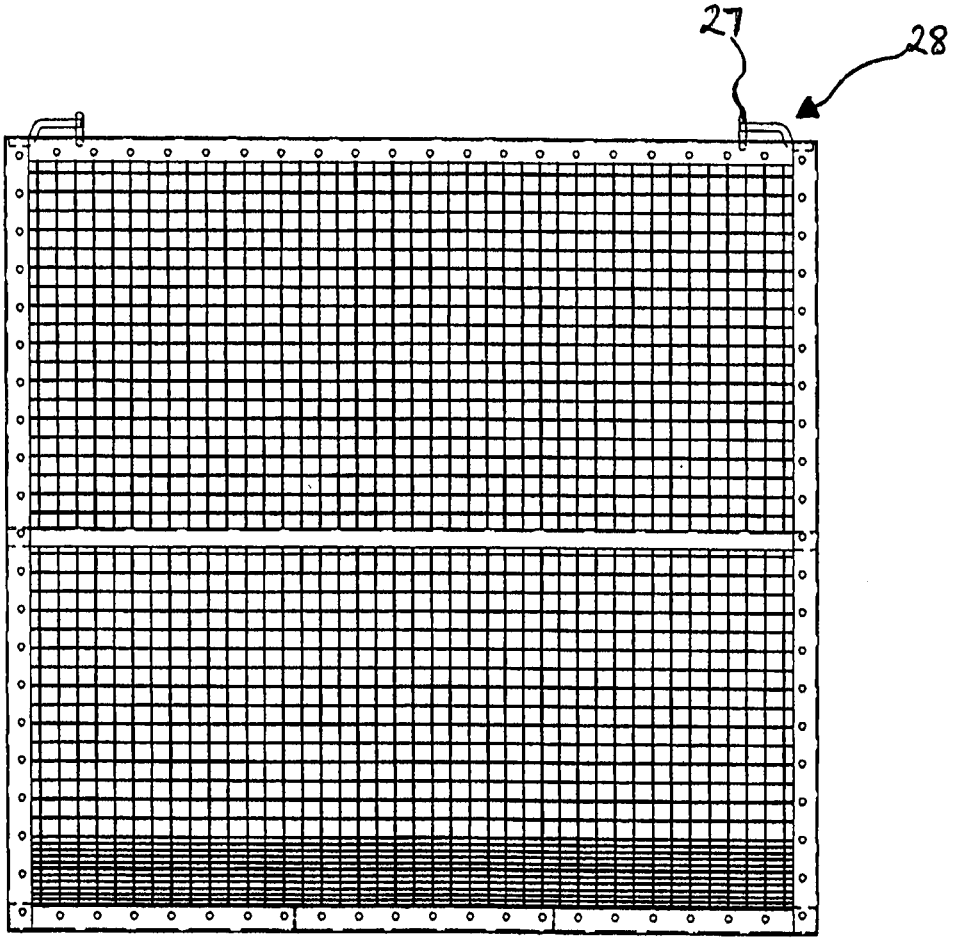
FIG. 5*b* is a front view of the scaffolding module of FIG. 4.
Figure 6:
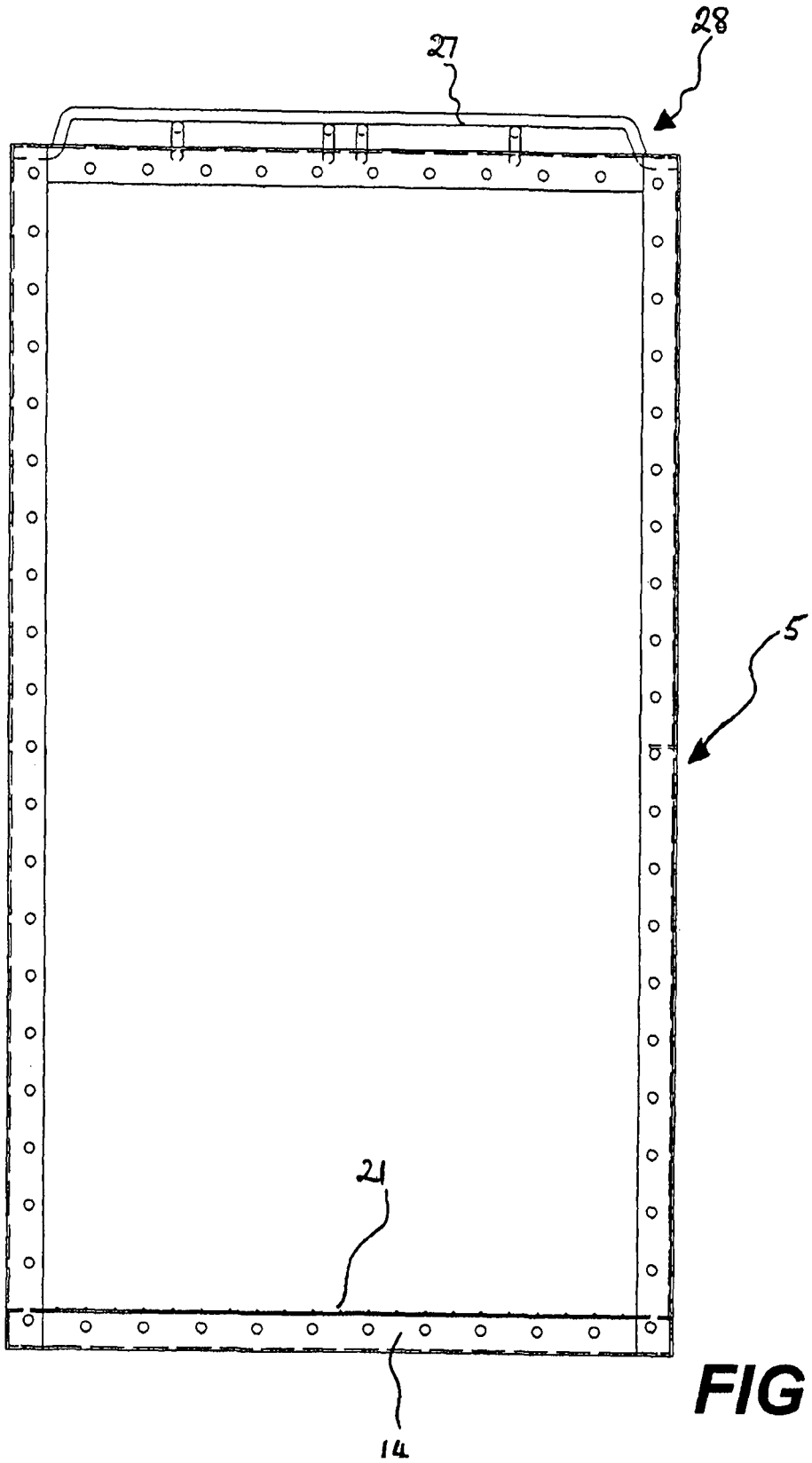
FIG. 6 is a side view of the scaffolding module of FIG. 4.

As illustrated in FIGS. 4 and 6, the floor mesh 21 is positioned above, and supported on, the transoms 19, and on the upper side of the lower horizontal bars 14. Thus the module 5, is provided with a recess 10 on the bottom face of the frame 11. This recess 12 forms part of the guide arrangement which will be detailed below.

A barrier in the form of a safety mesh 23 is provided on one face of the module. In use the modules are usually positioned so that the safety mesh 23 is on the outer face of the module facing away from the building 3. The safety mesh 23 may be 50 mm×50 mm×4 mm metal mesh. A handrail 25 is also provided for workers, and may be constructed of steel angle welded to the frame 11. The safety mesh 23 and handrail 25 provide a safety barrier for workers, as well as preventing the transgression of large debris or other objects through the scaffolding. The lower part of the safety mesh 23 is provided with a kickboard 24 for additional protection. The kickboard 24 may be constructed of denser metal mesh than the safety barrier, for example 50 mm×10 mm×4 mm, and extend approximately 150 mm above the scaffolding platform section 21.

At the top portion of module 5 is a guide structure 28, forming part of the guide arrangement. The construction and operation of the guide arrangement is best shown with reference to FIGS. 7*a*-7*c* and 8 and 9.

The guide structure 28 comprises a pair of bars 27 and associated supporting members protruding from the frame 11, as illustrated in FIGS. 7*a*-7*b*. The bars 27 form part of a guide structure 28 for aligning successive modules 5 that are mounted on top of another module 5.

Referring to FIG. 7*a*, the main axis of the bar 27 extends horizontally above the frame 11, and forms part of a guide structure extending from an upper face of the frame 11. At the end portions 29 of the bar 27, the bar 27 is angled towards the frame 11, and is affixed to the frame 11 by a weld. A series of intermediate support bars 31 are welded to support bar 27, to provide intermediate support to bar 27. The support bars 31, are disposed perpendicular to the bar 27, with the end portions 33 angled towards the frame 11, where it is affixed to the frame 11 by a weld.

The angled end portions 29 and 33, provide angled ramp surfaces to the guide structure 28. This allows the guide structure 28 of one module to enter the recess 12 of another module, and causing the two modules to self align as they are drawn together. As the bars 27 and 31 are generally perpendicular to each other, the angled end portions 29 and 33, provide self alignment in the two horizontal axes.

The bars 27 are preferably welded to the frame 11, and are of sufficient strength to function as lifting points for the modules 5. The bars 27 may be lashed to an overhead crane, which can then hoist the module into position.

Figure 8:
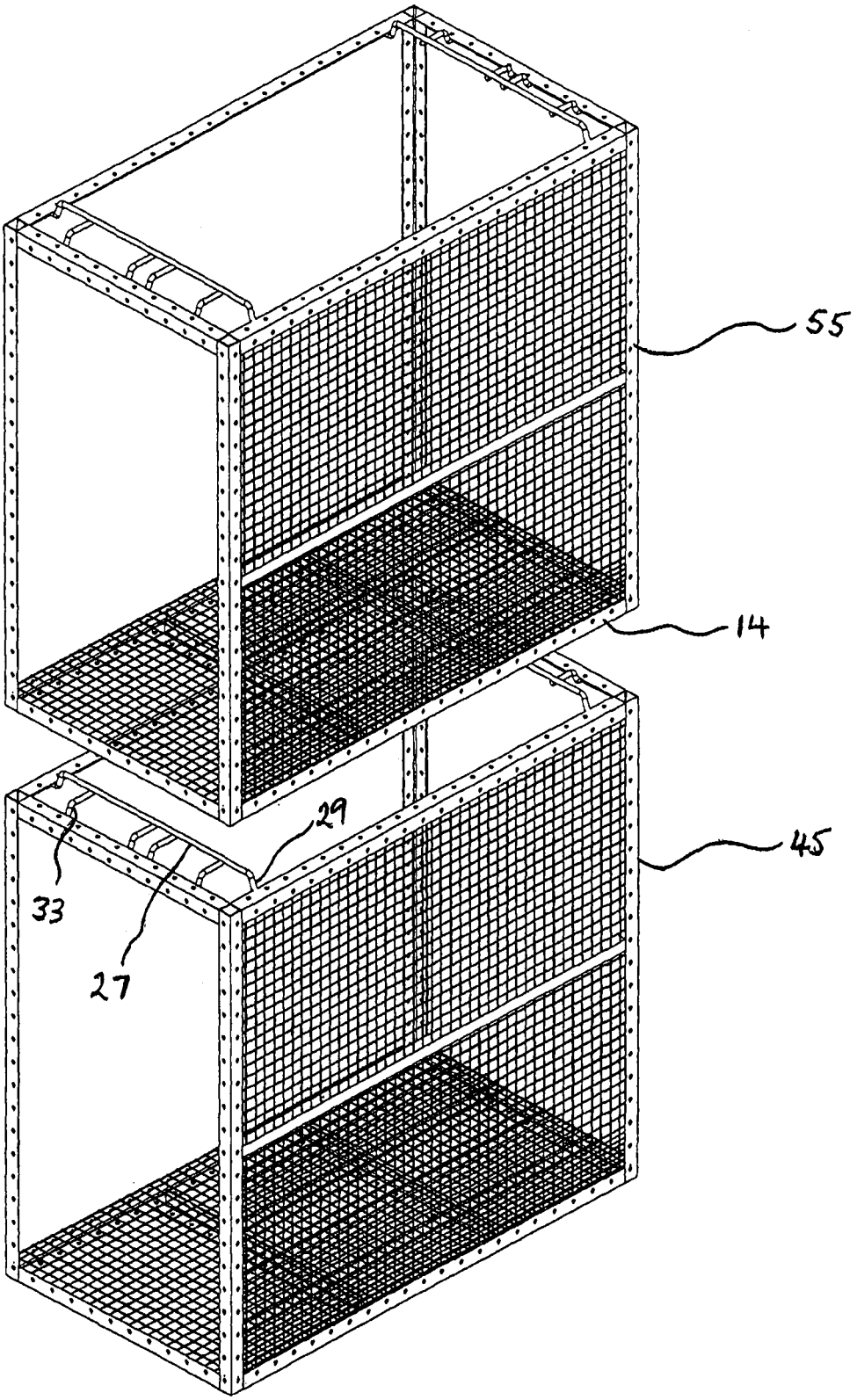
FIG. 8 is a perspective view of two scaffold modules just before stacking.

FIGS. 7*b* and 8 illustrates the upper 55 and lower 45 modules prior to mounting. It is clear the angled end portions 29 and 33, on entering the lower recess 12 in module 55, provide a ramp surface against the lower horizontal members 14, which line the recess 12 of the upper module 55. This ramp action guides the upper module 55 into alignment with lower module 45, during lowering of upper module 55.

As illustrated in FIG. 7*c*, the guide structure 28 of the lower module 45 extends into the lower recess 12 in the frame 11 of the upper module 55. The bars prevent sideway movement of the upper module 55 relative to the lower module 45. In use, the upper module 55 and lower module 45 would additionally be secured together with mechanical fasteners through apertures 17. In addition to providing horizontal rigidity, this will prevent the upper 55 and lower 45 modules from separating.

Figure 9:
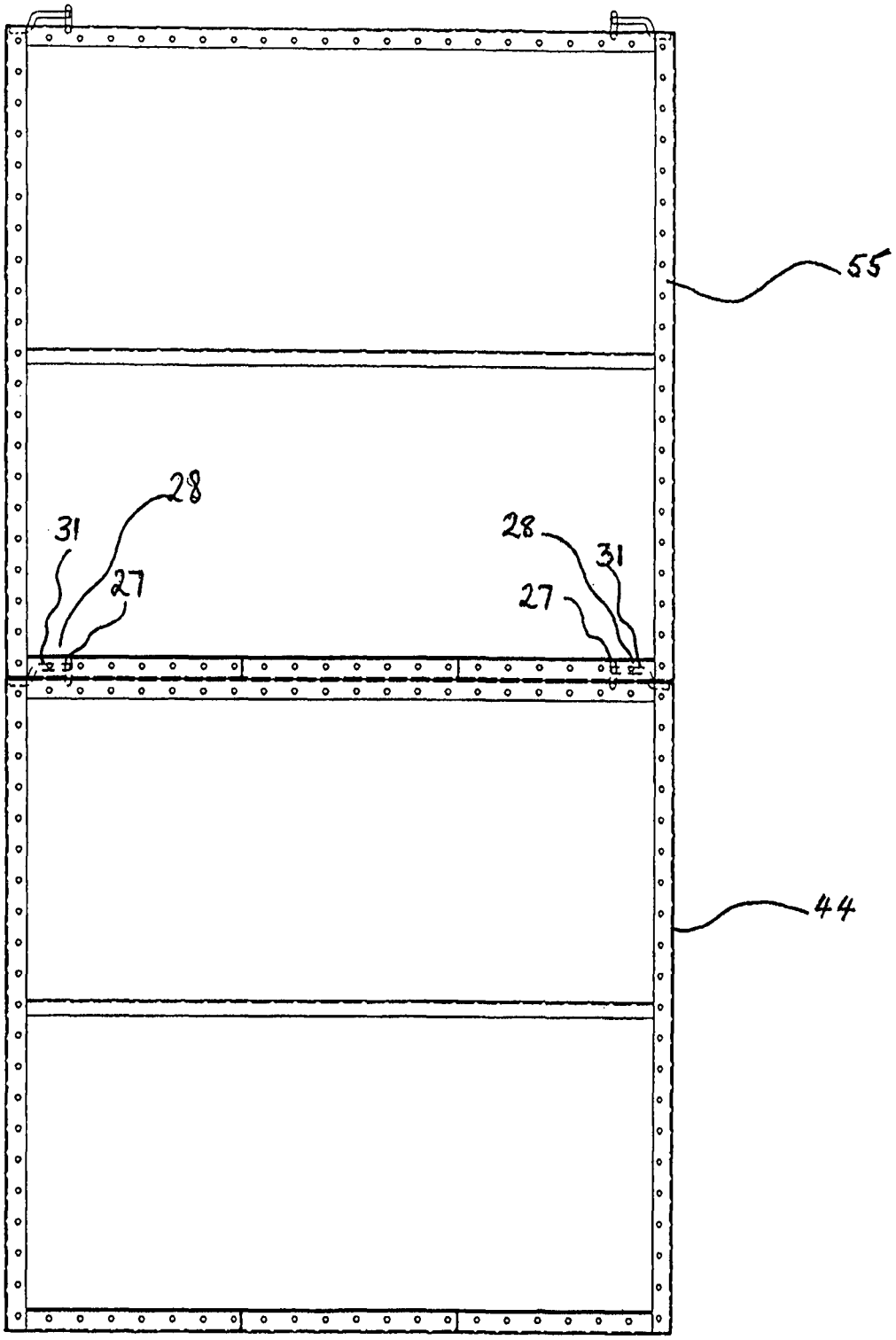
FIG. 9 is a front view of a scaffold module stacked on another scaffolding module.

FIG. 9 illustrates a pair of identical modules 5, with an upper module 55 mounted on top of a lower module 45. As can be seen the guide arrangement is fully enclosed within the frames of the 2 modules so that the module frames are in face to face contact. The erection of the scaffolding system 1 will now be described. The ground supporting the scaffold bases 9 is initially prepared for supporting the weight of the scaffolding assembly 1. This may include compacting the earth, paving, or setting a concrete foundation. A plurality of scaffold bases 9 may then arranged around the perimeter of the building 3. The scaffold bases 9 are arranged to support the modules 5, and thus the planar layout of the scaffold bases 9 generally provides the overall planar arrangement of the overall scaffold assembly 1.

The scaffold bases 9 are then adjusted to ensure the scaffold bases 9 are level. This may be achieved by altering the height of legs 10 of the scaffold base 9. In one embodiment the legs 10 comprise of adjustable screw jacks. The level of the scaffold bases may be monitored by a spirit level, or other suitable equipment. Once the scaffold bases 9 are satisfactorily level, adjacent scaffold bases 9 are secured to each other. Optionally, the scaffold bases may also be tied to the building 3 or other support structure.

The modules 5 of the scaffold assembly 1 may then be arranged onto the scaffold bases 9. A hoist 7 is attached to the bars 27 of a module, and the module is hoisted onto a corresponding scaffold base 9. The module 5 is then fastened to the scaffold base 9, by bolts and nuts through apertures 17 on the lower members of the frame 11, and corresponding apertures on the scaffold base 9. Subsequent modules 5 are then hoisted and located onto the remaining scaffold bases 9, and fastened therein. Optionally, the scaffolding modules 5 are further fastened to one another and/or tied to the building 3.

Figure 10:
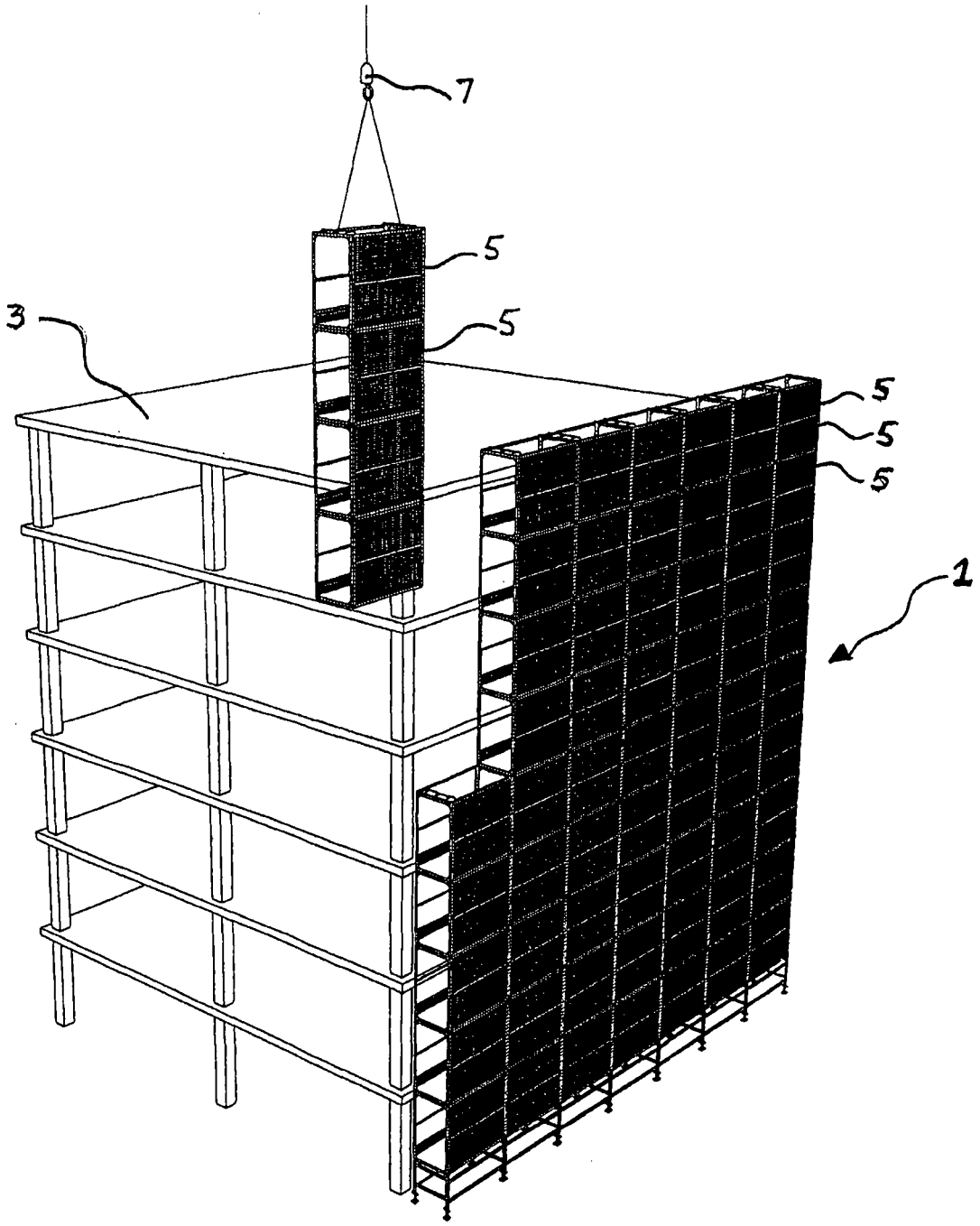
FIG. 10 is a perspective view of partially erected modular scaffolding, with multiple modules hoisted concurrently.

Further modules 5 are arranged above the scaffold bases 9 and preceding modules 5, until the desired scaffolding assembly 1 is erected. For better efficiency in erection, it may be desirable to mount two or more modules 5 together before hoisting the mounted modules to the desired location on the scaffolding assembly 1 as illustrated in FIGS. 10 and 11. This reduces the number of hoists and reduces the number of mounting operations by the scaffolder once the modules are positioned. This saves time, thus providing a secured scaffolding assembly in less time.

Figures 11A, 11B:
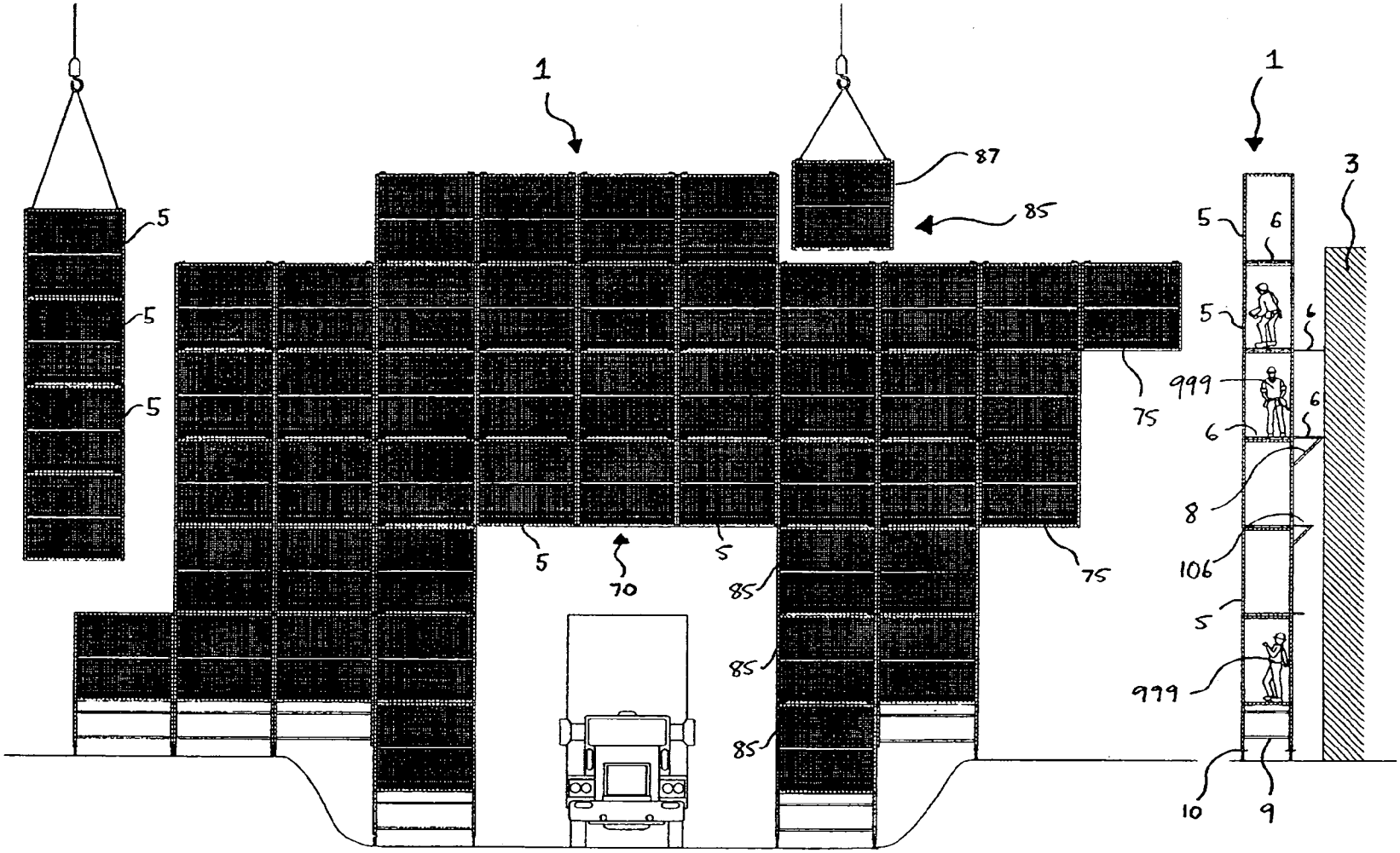
FIG. 11*a* illustrates a front view of partially erected modular scaffolding.
FIG. 11*b* illustrates a side view of partially erected modular scaffolding of FIG. 11*a*, with workers inside.

As illustrated in FIG. 11*a*, an archway 70 or bridge in the scaffolding assembly 1 may be formed by mounting modules 5 side by side over a span. Furthermore, the scaffolding assembly may comprise overhanging modules 75, which are supported by adjacent modules at the side and/or above the module 75.

In a further embodiment illustrated in FIG. 11*a*, stairway modules 85 comprising a rigid frame 11 and an internal staircase 87, are incorporated in the scaffolding assembly 1. This provides workers with convenient access to the platforms 6 on multiple levels of the scaffolding assembly 1.

FIG. 11*b* is a side view of FIG. 11 *a*, and illustrates the use of building tie 8, to mount the scaffolding assembly 1 to the building 3. The buildings ties 8 may also support part of platform 6. Furthermore, part of the platform 6 may also be a cantilevered platform section 106.

FIG. 11*b* also illustrates workers 999 inside the modules 5 of the scaffolding assembly 1.

Dismantling the scaffolding assembly 1, is achieve by substantially reversing the erection procedure. The top most module 5 is first demounted from the scaffolding assembly 1, allowing a crane 7 to hoist and lower the module 5 to ground level. To increase speed, two or more modules may remain coupled to each other and removed simultaneously from the scaffolding assembly 1. This process is repeated until the scaffolding assembly is disassembled. The module may then be transported for storage or to the next worksite. Advantageously, the rigid framed modules 5, with few or no working parts requires little setting up or configuration before use. Therefore, the modules 5 may simply be transported to the worksite by truck, and a crane can simply hoist the modules 5 from the truck to the scaffolding assembly 1.

The modules 5 may be stored in a storage yard when not in use at worksites. The modules may be arranged in a three dimensional matrix, with modules mounted side by side, front to rear, and stacked above each other. This storage arrangement, similar to storage of shipping containers, allows maximum use of storage yard space. The modules 5 may be mounted to each other for security and stability. The modules 5 may also be mounted to each other in clusters, for example 3 or 5 units in a vertical stack. The vertical stack of modules 5 can then be handled as one during storage and transportation, thereby obtaining better economy of effort and time.

Figure 12:
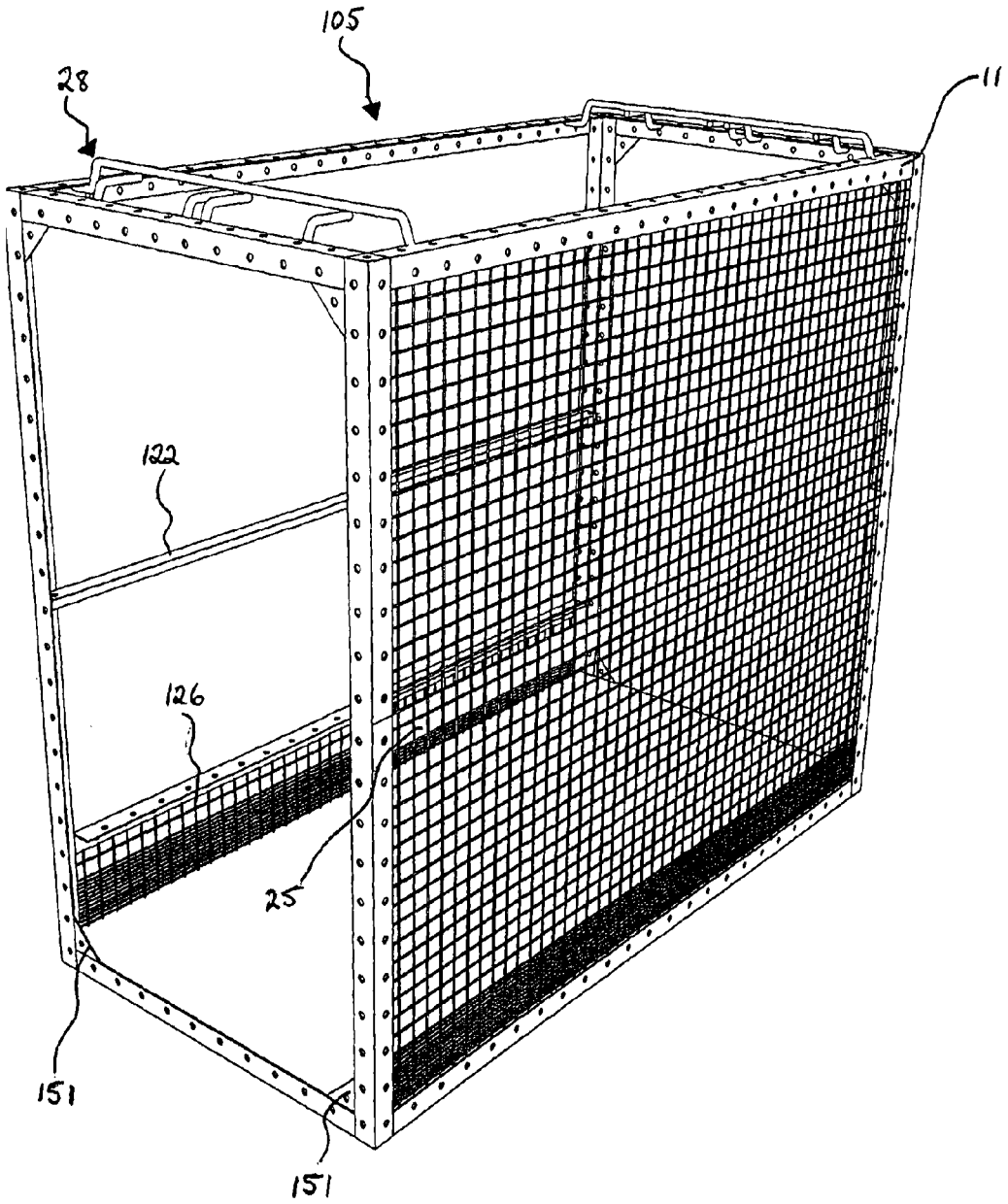
FIG. 12 is a perspective view of a further embodiment of a scaffolding module.
Figure 13:
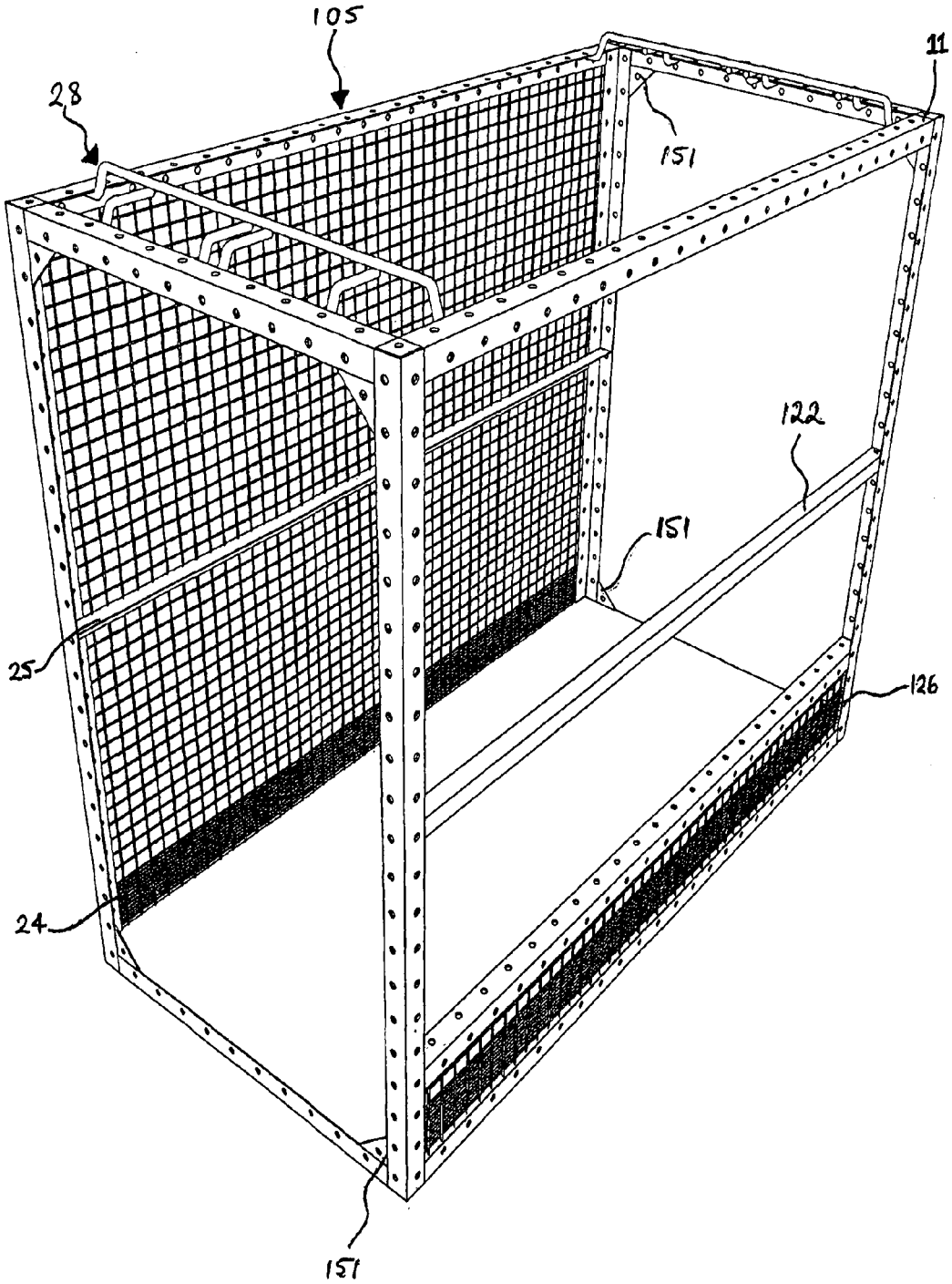
FIG. 13 is another perspective view of the module of FIG. 12.
Figure 14:
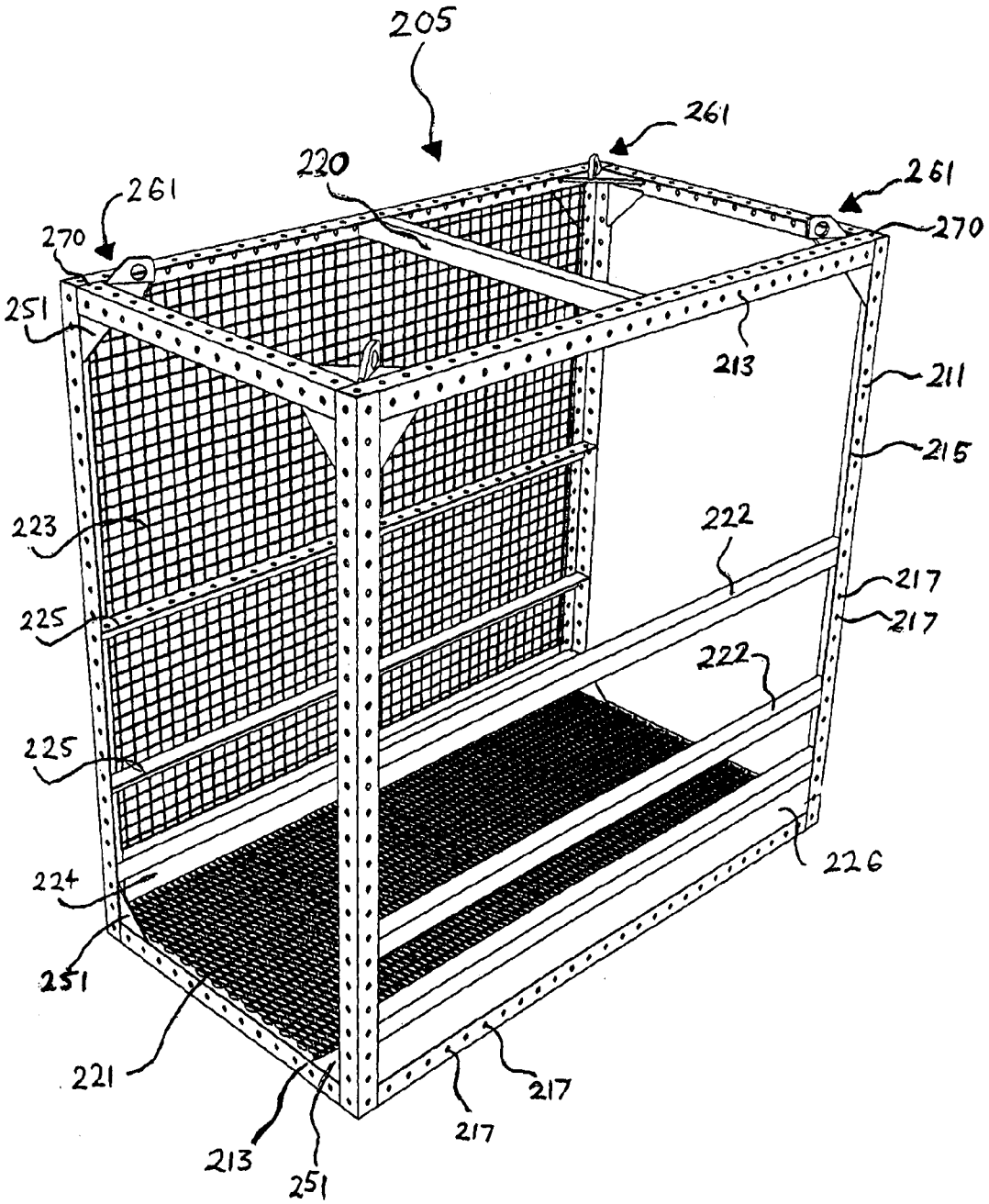
FIG. 14 is a perspective view of another embodiment of a scaffolding module.
Figure 15:
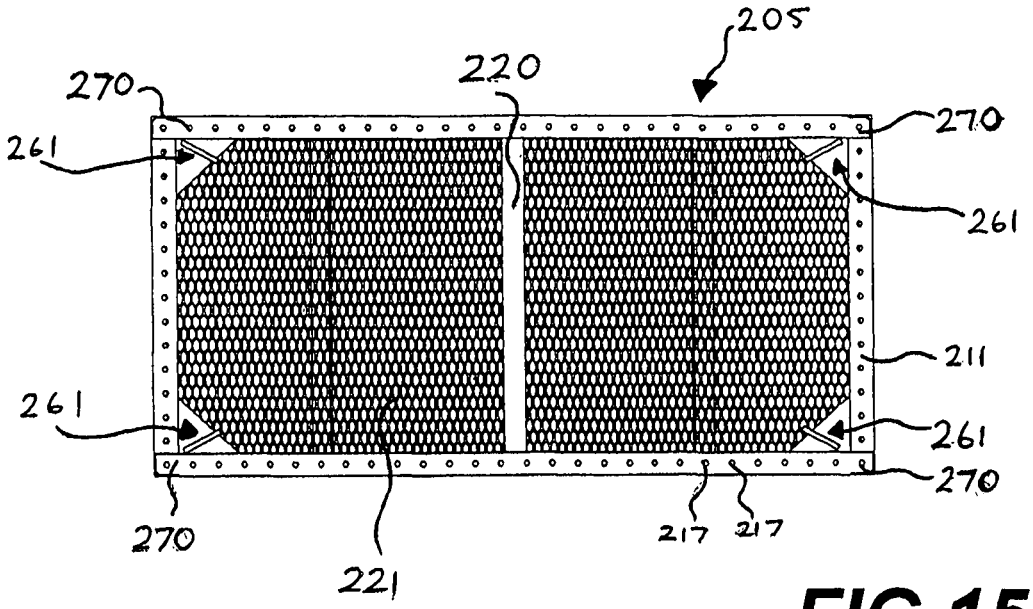
FIG. 15 is a top view of the module of FIG. 14.
Figure 16:
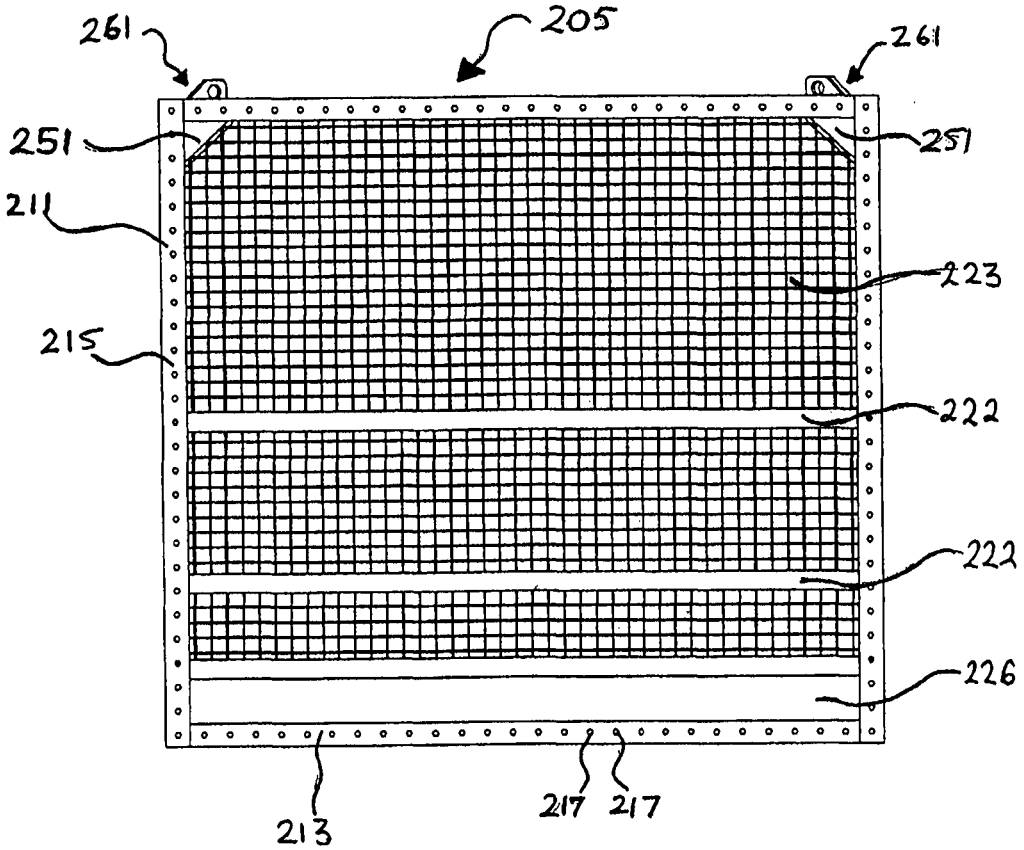
FIG. 16 is a rear view of the module of FIG. 14.
Figure 19:
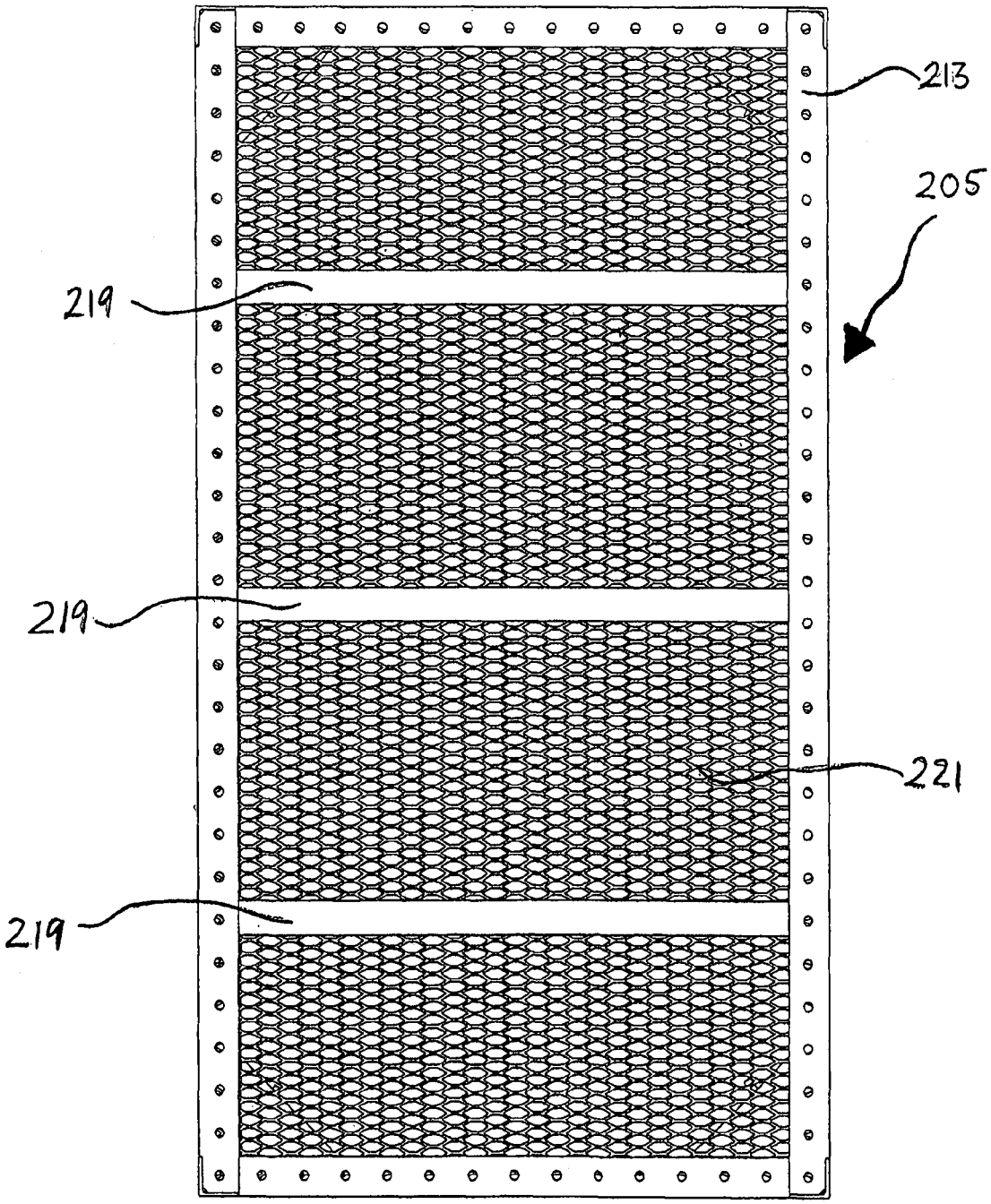
FIG. 19 is a bottom view of the module of FIG. 14.

FIGS. 12 and 13 illustrate another embodiment of the scaffolding module 105. The module 105 has an internal kickboard 126 made from mesh or metal sheet disposed at the inner face of the module 5. An inner handrail 122 comprising of steel angle is also provided at the inner face. The kickboard 126 or inner handrail may be removable or permanent. Gussets 151 are provided to increase rigidity and strength of the frame II.

In alternative embodiments, the modules may comprise of the frame without the scaffolding platform sections. The scaffolding platform sections may be positioned and mounted to the scaffolding assembly, after the modules comprising the frames are erected.

In another alternative embodiment the scaffolding module may comprise of a rigid frame, wherein part of the frame is formed from at least one scaffolding platform section. Advantageously, this may reduce the number of parts when manufacturing the modules.

In the illustrated embodiments, the modules are stacked vertically above one another. However, it is to be appreciated other bond patterns, such as a stretcher bond pattern may be used for erecting the scaffolding assembly 1. In such an arrangement, the modules are staggered in adjacent rows.

Another embodiment of the scaffolding module 205 will now be illustrated with reference to FIGS. 14 to 19. Features of the scaffolding module 205 that are similar to the features previously described embodiment are denoted by the same reference numerals preceded by "2".

In this embodiment, handrails 222, 225 are provided in pairs to provide an upper and lower handrail for additional use for workers. A transom 220 is provided at the top portion of the frame 211, to enhance rigidity of the module 205. The floor mesh 321 may be made of expanded metal floor or decking.

The kickboard 224 is constructed of steel sheet, which can by permanently fixed or removable. In one form, it can be permanently welded to the frame 211. Advantageously a sheet steel kickboard is easily welded and prevents transgression of fine debris.

A distinguishing feature of this embodiment of the scaffolding module 205 is the alternative guide arrangement comprising of a guide lug assembly 261 located at corners 270 at the top portion of the module 205. Part of the guide lug assembly 261 is adapted to be received into a recess 12 in the bottom face of the module 205, which is substantially the same as the recess 12 described in the earlier embodiments.

The construction of the guide lug assembly 261 will now be described with reference to FIG. 20. The guide lug assembly 261 comprises of a gusset plate 263, and a protruding lug 265. The gusset plate 263 is welded to the frame 211, and is substantially planar to the top face of the module 205. The lug 265 protrudes above the top face of the module 205, and is provided with a ramp 267 and an eyelet 269. The eyelet 269 in the lug 265 provides a lifting point to lift the scaffolding module 205.

The lug 265 is angled towards the corner 270 of the frame 211 at an angle of approximately 45° from the horizontal members 213. The ramp 267 of the lug 265, on entering the recess 12 of another module and bearing on the frame of the other module, will guide the two modules to self align as they are drawn together. Since the lug 265 is angled at 45°, it will provide alignment in two horizontal axes. It would be appreciated the method of lowering one module on top of another with this alternative guide arrangement is similar to the previously described methods.

Figure 20:
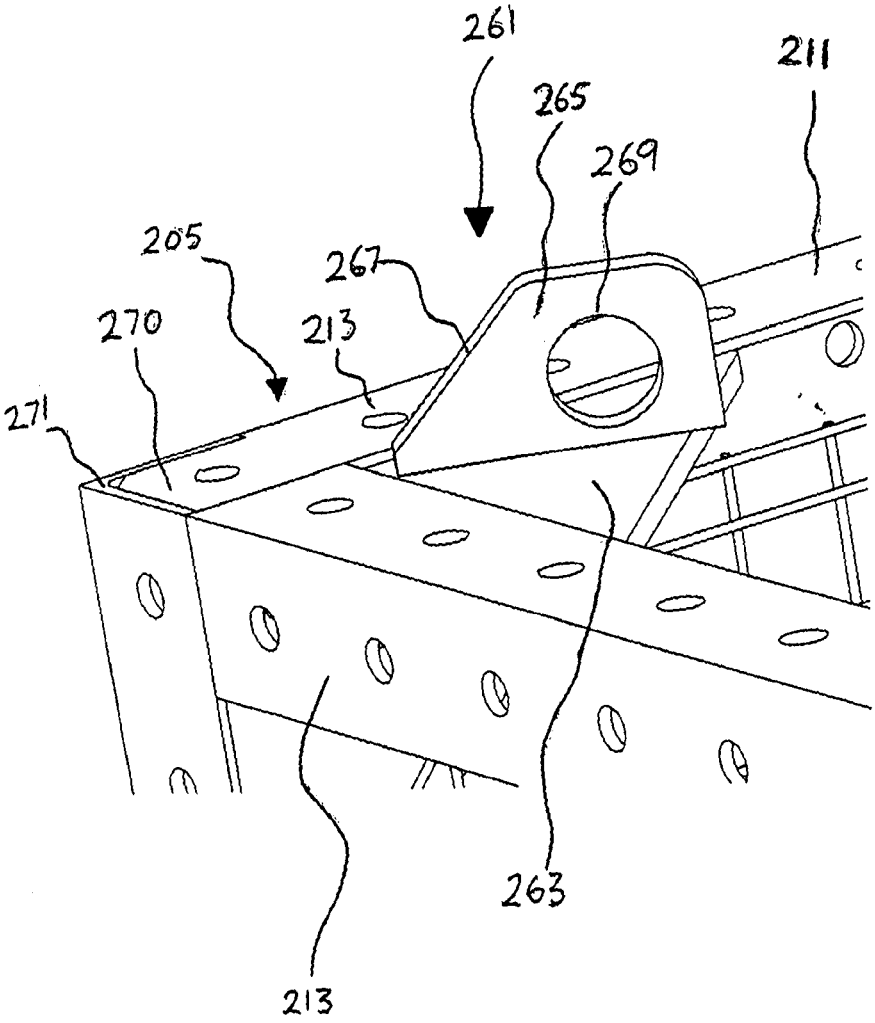
FIG. 20 is a close up perspective view of an upper corner of the module of FIG. 14, showing the guide lug assembly.
Figure 23:
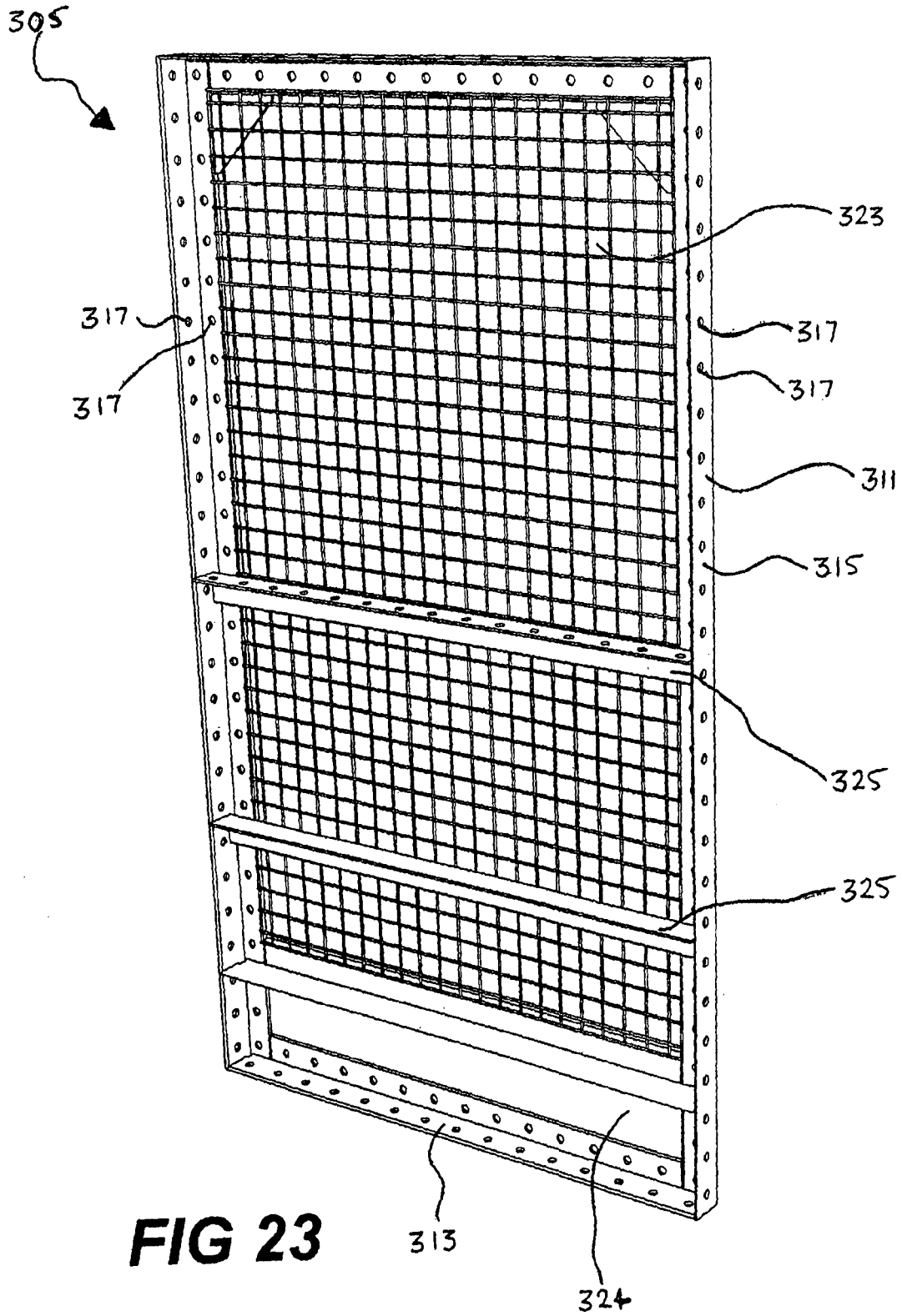
FIG. 23 is a perspective view of a panel for with the scaffolding modules.
Figure 24:
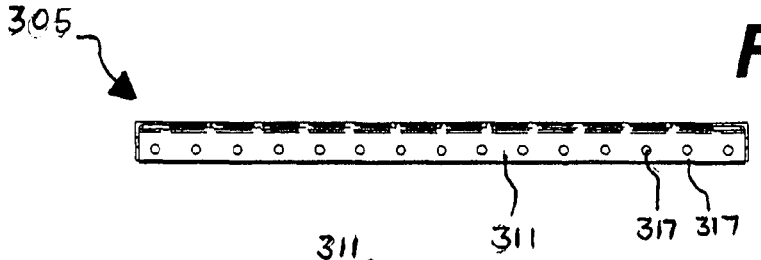
FIG. 24 is a sectioned top view of the panel of FIG. 23.
Figure 25:
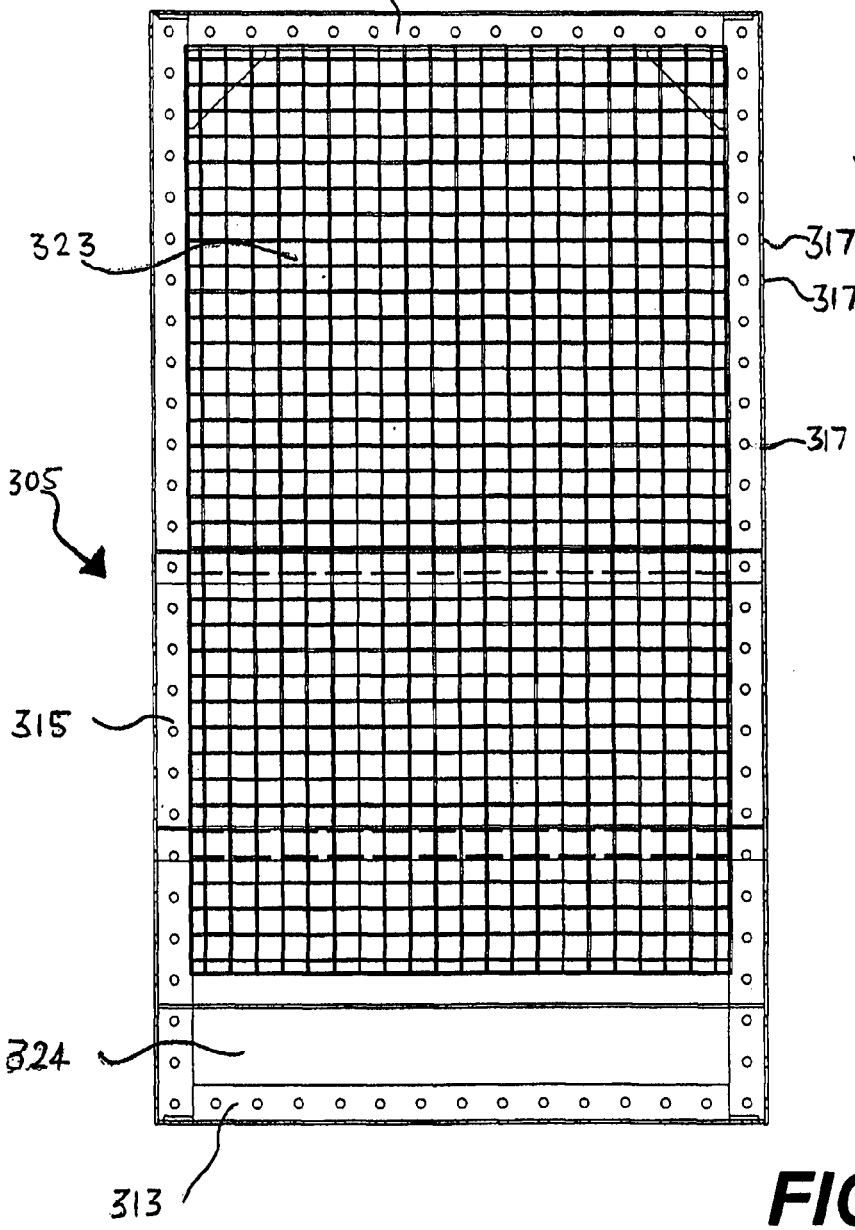
FIG. 25 is a sectioned front view of the panel of FIG. 23.
Figure 26:
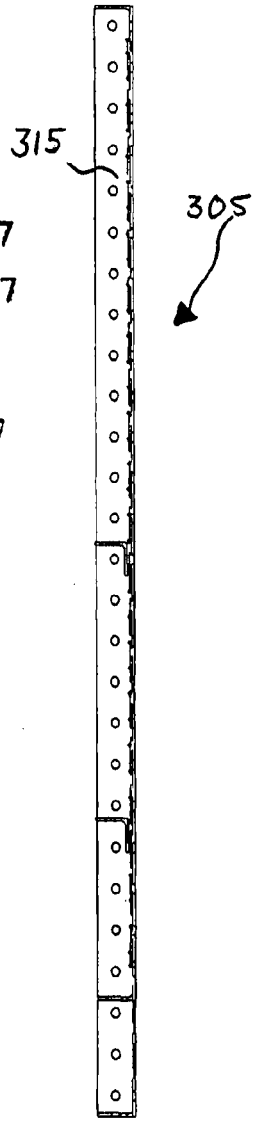
FIG. 26 is a sectioned side view of the panel of FIG. 23.

As previously described, the frame members 213, 215 are constructed of steel angles, having a right angle profile 271 as illustrated in FIGS. 20 to 22. As frame members 213, 215 of adjacent modules 205 are drawn together, as illustrated in FIG. 22, the frame members form a T-section. This is best illustrated in FIG. 21. When frame members of adjacent members are further secured to one another by fastening, such as by nut 216 and bolt 218 through apertures 217, the surfaces of the members become in intimate contact with each other. Thus two fastened members effectively act as a unitary T-section structure, thereby enhancing the rigidity of the scaffolding modules.

A panel 305 for use with the scaffolding modules 205 will now be described with reference to FIGS. 23 to 26. The panel 305 comprises of a frame 311, having horizontal frame members 313 and vertical frame members 315. The frame members 313, 315 are formed of steel angles with aperture 317, similar to the scaffolding modules 205, to form part of the mounting regions on the panel 305. The panel 305 is further provided with a safety mesh 323, a kick plate 324, and handrails 325, similar to those provided on the scaffolding modules 205.

In the illustrated embodiment, the panel 305 is dimensioned to have the same height as the scaffolding module 205, and a width equivalent to the sides of the modules 205. However, it is to be appreciated panels of other dimensions may be used.

Figure 27:
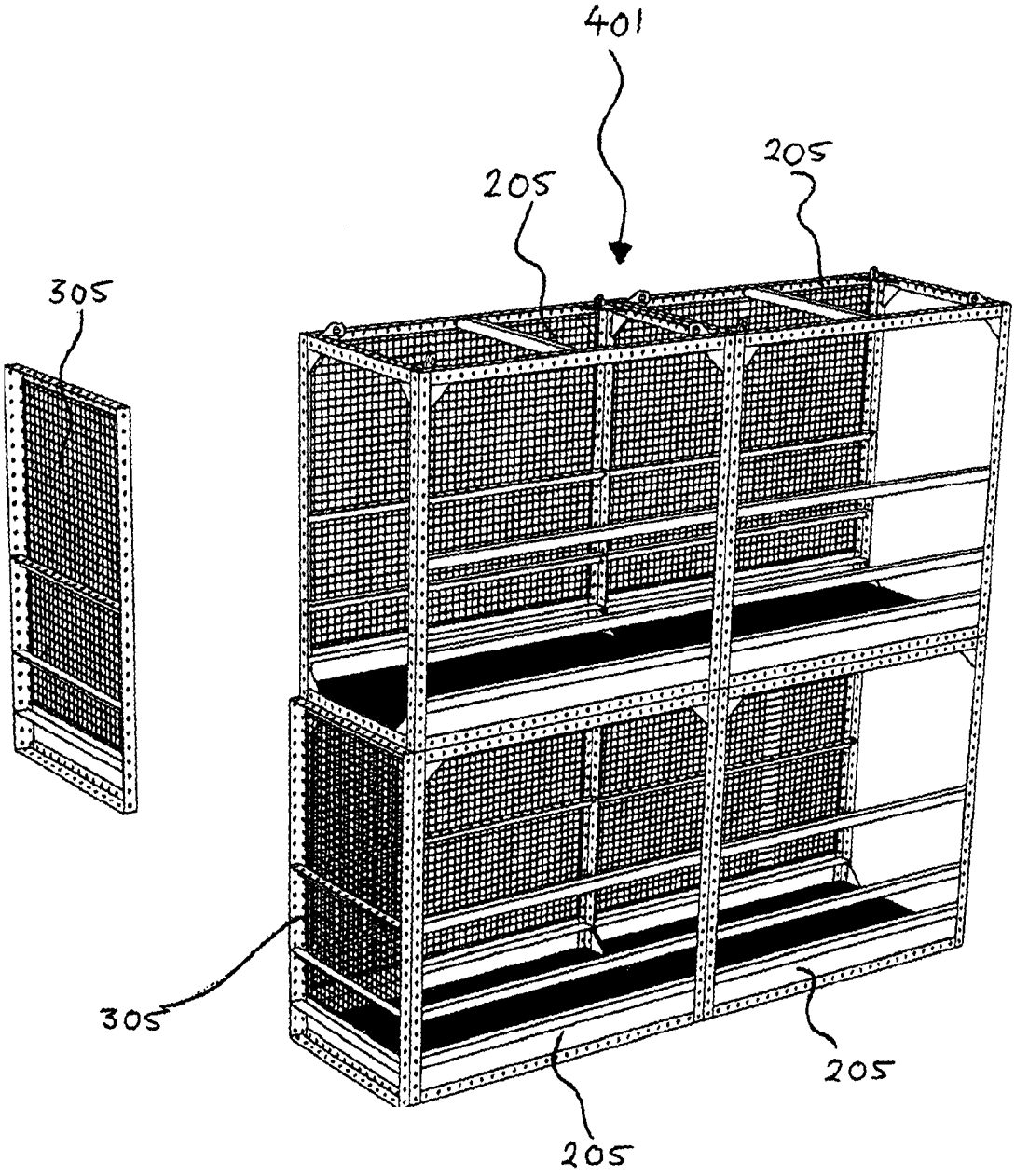
FIG. 27 is a perspective view of a scaffolding assembly illustrating the panel as an end panel.

The use of the panel 305 as an end piece will now be described with reference to FIG. 27. FIG. 27 illustrates an assembly of four scaffolding module 205 mounted to form a scaffolding assembly 401, with one panel 305 attached to a side face of a scaffolding module 205. As illustrated, the frame 311 of the panel 305 is the same dimension as frame 211 at the side face of module 205. Advantageously, the apertures of the panel 305 and module 205 are matched to enable fasteners to secure the panel 305 to the module 205. The panel 305 as an end piece closes off an otherwise open end of the assembly 401, thereby protecting workers or equipment from falling out of the scaffolding assembly 301.

Figure 28:
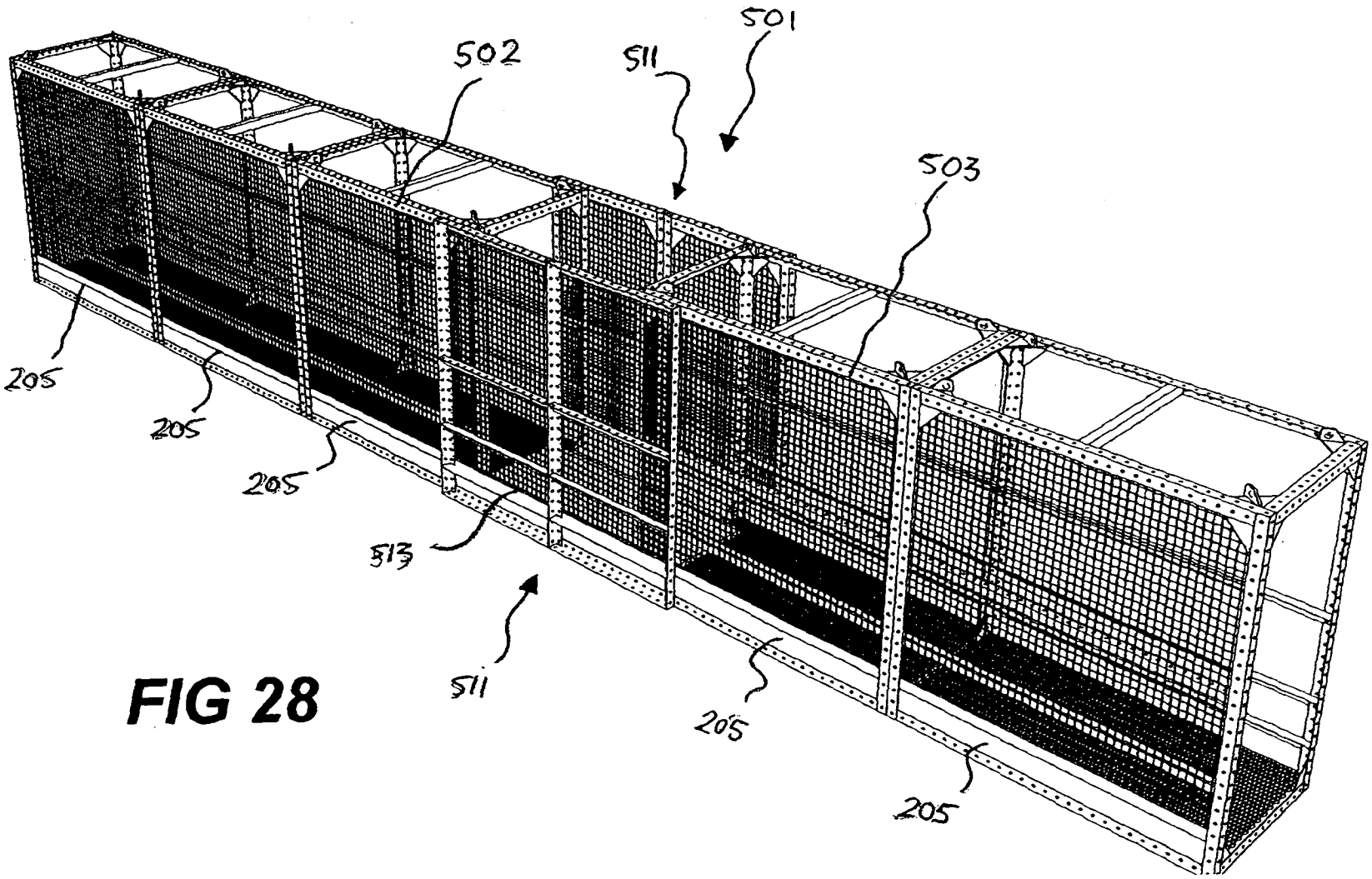
FIG. 28 is a perspective view of a scaffolding assembly illustrating the use of the panel to interconnect spaced scaffolding modules.

An alternative use of the panel 305 to interconnect spaced modules 205 will now be described with reference to FIG. 28. In FIG. 28, there is provided a scaffolding assembly 501, comprising of a plurality of scaffolding modules 205, including modules 502 and 503, which are spaced from one another. There is also provided panel assemblies 511, formed of two panels 305 with the sides mounted to each other.

As illustrated, the panel assemblies 511, overlap and are mounted to a surface of modules 502 and 503 to bridge the space between the modules. A plank 513 may be placed over the floor mesh 221 of modules 502 and 503, to provide a bridging platform for workers to walk across.

Advantageously, this allows continuity of the scaffolding where the space between two modules 205 is not large enough accommodate a single module 205. This also allows the dimensions of the scaffolding assembly 501 to be adjustable to a degree finer than the size of the discrete scaffolding modules 205.

Figures 29, 30:
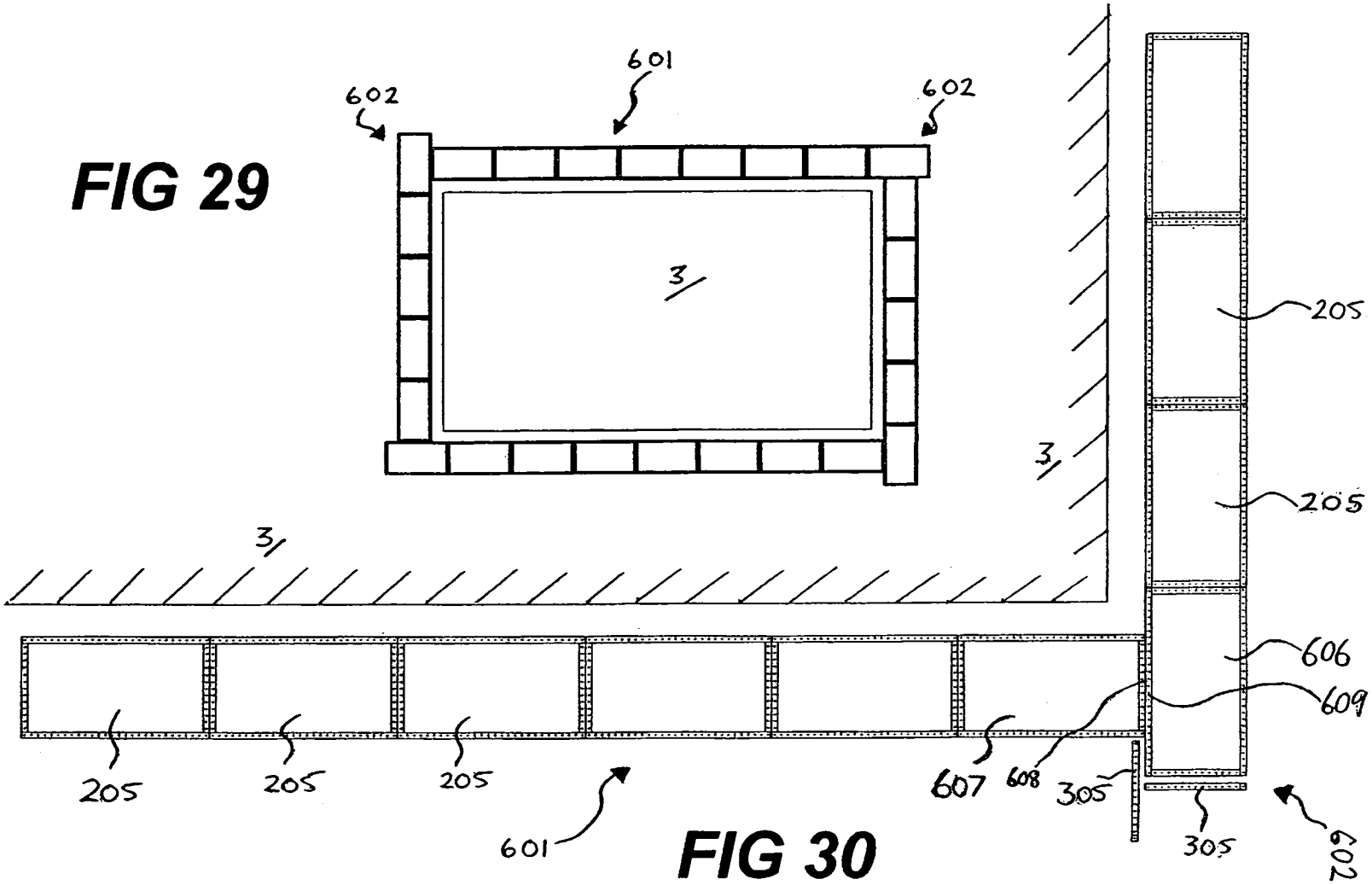
FIG. 29 is a top plan view of an arrangement of scaffolding modules around a building.
FIG. 30 is a detailed view of a portion of the arrangement in FIG. 29.

FIGS. 29 and 30 illustrate a scaffolding assembly 601 around a building 3. The scaffolding assembly 601 has assembly corners 602 comprising of scaffolding modules 606 and 607 which are identical to the other scaffolding modules 205. In the illustrated embodiment, it is clear the required dimension of the scaffolding assembly 601 for building 3 does not fall on exact multiples of the dimensions of the scaffolding modules 205. Thus the arrangement of the scaffolding modules 205 need to be adjusted for the assembly 601 to accommodate the building 3. In order to achieve this, the end face 608 of module 607, is positioned along the length of inner face 609 of module 606. Advantageously, the end face 608 can be located and mounted anywhere along inner face 609 of module 606 and the adjacent module. This allows adjustment of the dimensions of the scaffolding assembly 601 at an increment equal to the spacing of apertures 217 in the modules 205.

FIG. 30 also illustrates panels 305 that can be mounted to the scaffolding assembly 601 to close off open areas at the corner 602 to ensure the safety of workers and equipment in the scaffolding assembly 601.

Figure 31:
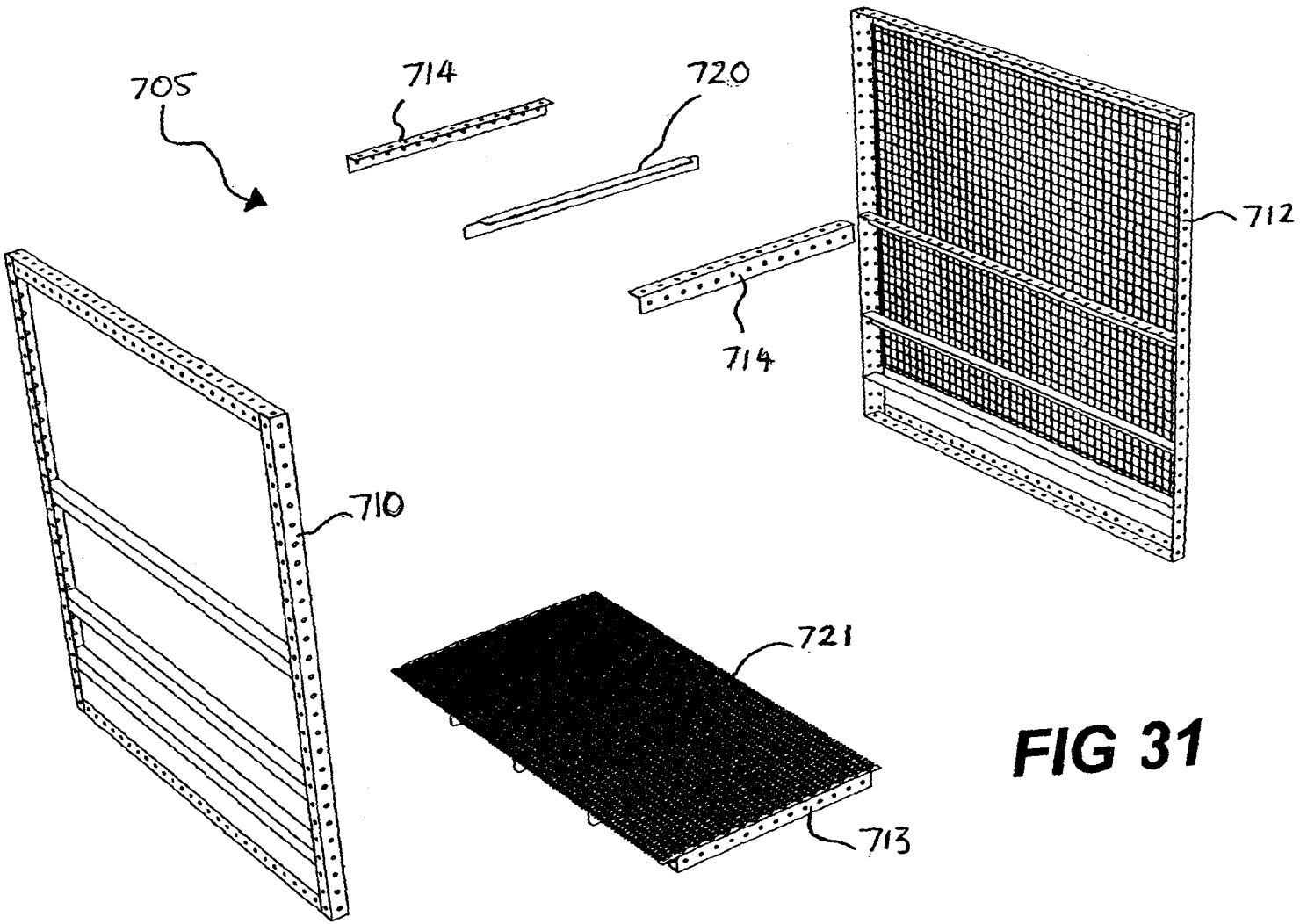
FIG. 31 is an exploded perspective view of another embodiment of a scaffolding module.
Figure 34:
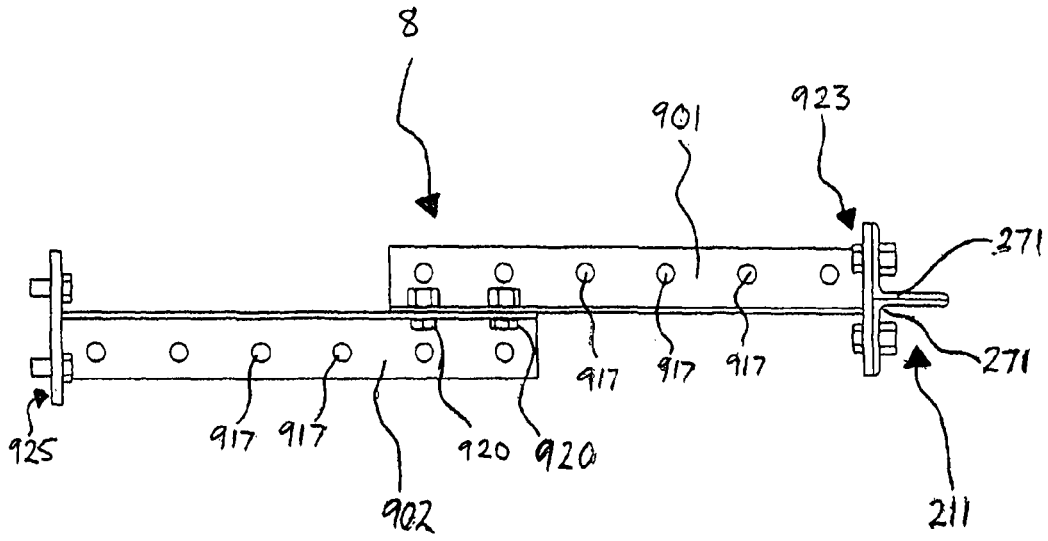
FIG. 34 is a top view of a tie for use between the building and the scaffolding modules.
Figure 35:
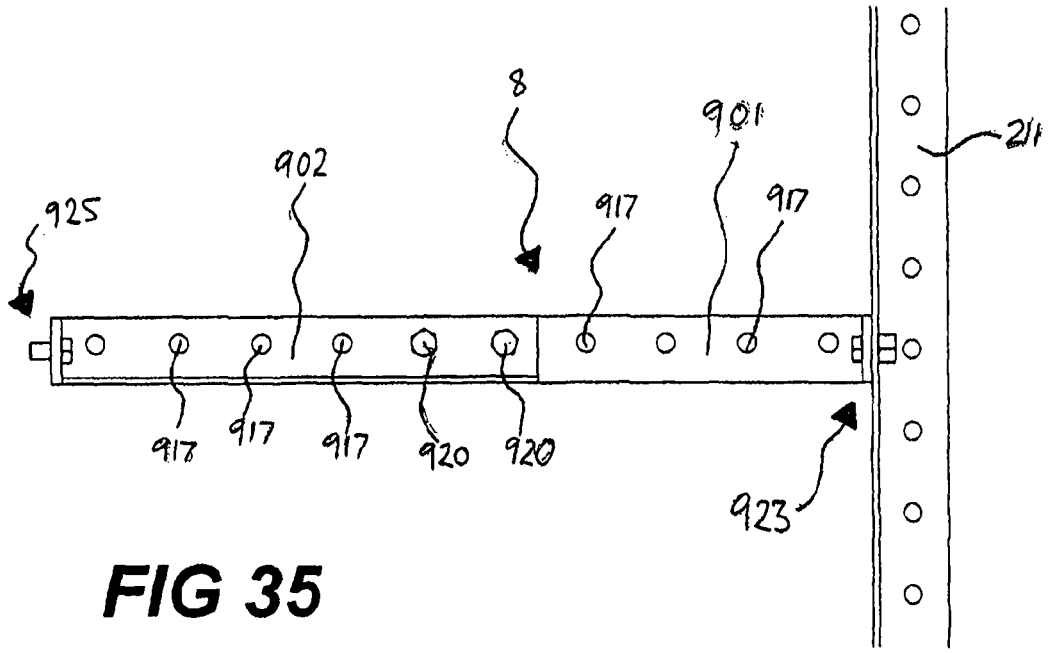
FIG. 35 is a side view of the tie in FIG. 34.

Another embodiment of the scaffolding module 705 will now be described with reference to FIG. 31. In this embodiment, the frame members 710, 712, 713, 714 of the scaffolding module 705 are interconnected by releasable connections. As illustrated in FIG. 31, the frame members are released from each other as discrete components of the frame member. In-use, the frame members 710, 712, 713 and 714 are connected to each other with fasteners or the like to form a scaffolding module 705 similar to scaffolding module 205 described above.

FIGS. 32 to 33 illustrate another embodiment of the scaffolding module 805, having joints to allow the module to adopt a collapsed configuration. FIG. 32 is a side view of the scaffolding module 805 in the rigid in-use or erected configuration, the module comprising of floor frame member 813, inner and outer face frame member 810 and 812, and top frame member 814. The frame members are pivotally interconnected at joints 816, and in-use are locked by releasable connections such that the frame members are rigid relative to each other. When in the rigid in-use configuration, the module 805 will have similar features and characteristics as the modules described in the embodiments above.

To save space during transportation or storage, the scaffolding module 805 may be collapsed as illustrated in FIG. 33. The releasable connections are released, thereby allowing the frame members to pivot at the joints 816 so that the frame members are configured to be substantially parallel to one another.

An embodiment of the tie 8 will now be described with reference to FIGS. 34 to 37. The tie 8 comprises two elements 901, 902, each element having a series of apertures 917. The elements 901, 902 are adjustably fixed to each other by fasteners 920 that pass through apertures 917. Thus the overall length of the tie 8 is adjustable by selecting the appropriate apertures 917 for fastening.

The first element 901 is fastened to frame member 211 of a scaffolding module 205 at 923. The second element 902 is fastened to the building at 925. Thus the tie 8 ensures the scaffolding 1 and building 3 maintain constant spacing, as well providing mutual support.

Figure 36:
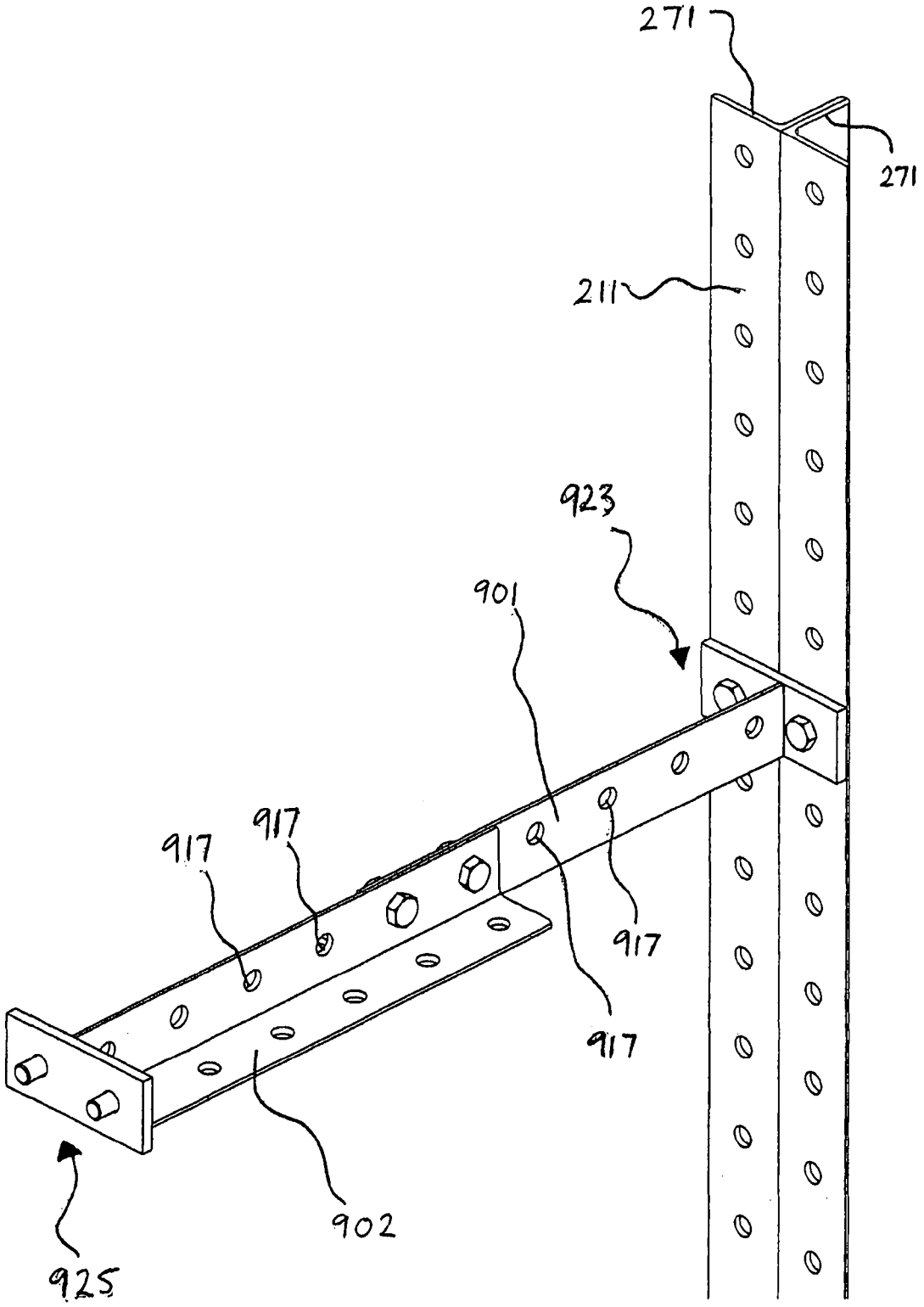
FIG. 36 is a perspective view of the tie in FIG. 34.
Figure 37:
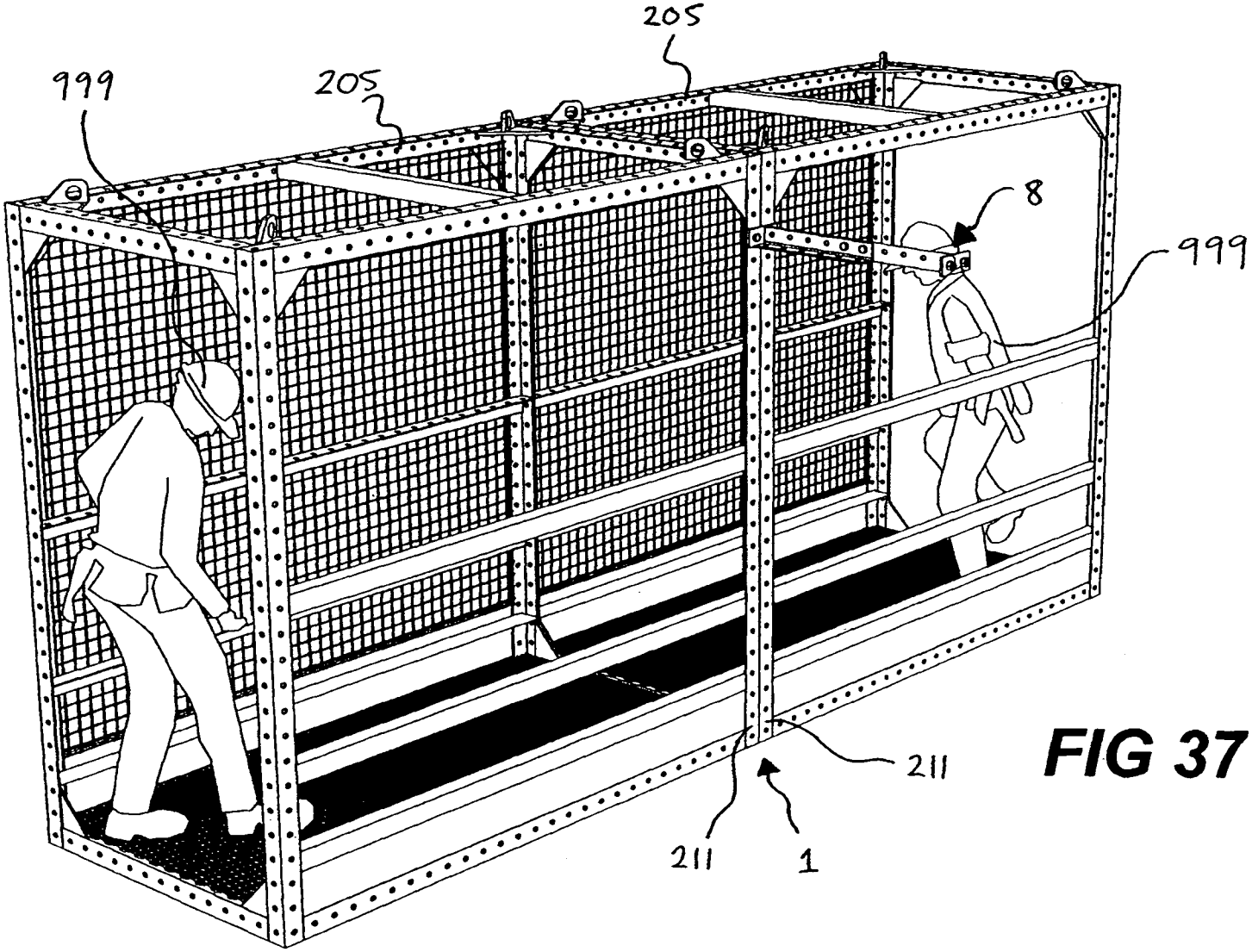
FIG. 37 is a perspective view of a scaffolding assembly with a tie, the assembly having workers inside.

Referring to FIGS. 36 and 37, the tie 8 is fastened to two frame members from a pair of scaffolding modules 205. Advantageously, as the tie 8 is fastened to the T-section formed by a pair of frame members, it ensures the tie is rigidly secured to the overall scaffolding assembly 1.

FIG. 37 also illustrates workers 999 inside the scaffolding assembly 1. Advantageously, the open sides of the modules 5 allow the workers 999 to freely pass between adjacent modules 5, whilst protected by the structure of the scaffolding assembly 1.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A scaffolding module comprising:

a frame that, when in an erected configuration, defines an interior space configured to receive workers;

a plurality of mounting regions that allow the scaffolding module to be mounted with other said scaffolding modules, the mounting regions being disposed (i) on upper and lower faces of the frame such that the scaffolding module may be mounted with other said scaffolding modules one on top of the other to form multiple levels of scaffolding and (ii) on opposite side faces of the frame such that the scaffolding module may be mounted with other said scaffolding modules in side by side relation, wherein at least some of the mounting regions are configured as surfaces which are arranged to mount in face to face relation with a corresponding mounting surface of another said scaffolding module, and wherein when arranged to be mounted in side by side relation, the opposite side faces have openings to allow the workers to freely pass to another said scaffolding module;

at least one scaffolding platform section disposed in and supported by the frame; and a guide arrangement configured to align at least one mounting region of the scaffolding module with a mounting region of another scaffolding module when the scaffolding module is mounted to the other scaffolding module, the guide arrangement comprising a guide structure that extends from one of the upper or lower face of said frame, and a recess in an opposite one of said upper or lower faces of the frame, wherein one or both of (i) the guide structure, and (ii) the recess, comprises at least one ramped surface for aligning the scaffolding module on top of the other scaffolding module, the ramped surface being configured to guide the scaffolding module and the other scaffolding module such that the scaffolding module and the other scaffolding module self-align as they are drawn together for mounting purposes, wherein the guide structure provides a lifting point in the form of at least one guide lug comprising an eyelet that is configured to provide a location to attach the scaffolding module to a lifting device.

2. The scaffolding module of claim 1, wherein at least some of the mounting regions include pre-formed holes to receive mechanical fasteners to secure the said scaffolding module to one or more other scaffolding modules.

3. The scaffolding module of claim 1, wherein the frame comprises a plurality of frame members that are interconnected by rigid connections.

4. The scaffolding module of claim 1, wherein the frame comprises a plurality of frame members and at least some of the frame members are interconnected by releasable connections to allow the scaffolding module to adopt a collapsed configuration.

5. The scaffolding module of claim 1, wherein the frame comprises a plurality of frame members and at least some of the frame members are formed from profiled sections having an outer surface that forms a respective mounting region of said scaffolding module.

6. The scaffolding module of claim 1, wherein the frame comprises one or more elongate frame members, each having a generally L-shaped profile, the one or more elongate frame members being arranged to abut with corresponding elongate frame members of the other scaffolding module to form a T-section.

7. The scaffolding module of claim 1, wherein the frame is shaped as a prism.

8. The scaffolding module of claim 7 wherein the frame is cuboid.

9. The scaffolding module of claim 1, wherein when the scaffolding module is mounted with other said scaffolding modules, the frames of the scaffolding module and the other said scaffolding modules form a multi-level support structure for supporting (i) the at least one scaffolding platform section and (ii) one or more staircases within the multi-level support structure.

10. The scaffolding module of claim 1, further comprising a barrier structure extending across an in-use outer face of said scaffolding module.

11. The scaffolding module of claim 1, wherein the scaffolding platform section comprises a floor mesh.

12. A scaffolding assembly comprising:

a plurality of scaffolding modules that are mounted together, each scaffolding module being defined according to claim 1, to form a support structure.

13. The scaffolding assembly of claim 12, further comprising:

at least one panel comprising a panel frame and at least one mounting region that allows the panel to be mounted to at least one of the mounting regions of said scaffolding modules, wherein when so mounted to a particular scaffolding module of the said scaffolding modules, the panel covers at least a part of one face of the particular scaffolding module.

14. The scaffolding assembly of claim 12, wherein the frames of the scaffolding modules are formed from a plurality of frame members, at least some of the frame members being formed from angled sections, and wherein when the modules are connected together, the frame member angled sections of adjacent modules are fastened together and form a unitary structure that enhances the rigidity of the support structure.

* * * * *